US010262672B2

(12) United States Patent
Lu et al.

(10) Patent No.: US 10,262,672 B2
(45) Date of Patent: Apr. 16, 2019

(54) AUDIO PROCESSING FOR SPEECH

(71) Applicant: Verizon Patent and Licensing Inc., Arlington, VA (US)

(72) Inventors: Youhong Lu, Irvine, CA (US); Ravi Kalluri, San Jose, CA (US); Andrew Walters, Castroville, CA (US); Luigi Bojan, Orlando, FL (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

(21) Appl. No.: 15/658,842

(22) Filed: Jul. 25, 2017

(65) Prior Publication Data

US 2019/0035415 A1 Jan. 31, 2019

(51) Int. Cl.

| | |
|---|---|
| ***G10L 21/02*** | (2013.01) |
| ***G10L 25/21*** | (2013.01) |
| ***G10L 21/0232*** | (2013.01) |
| ***G10L 21/0224*** | (2013.01) |
| *G10L 21/0208* | (2013.01) |

(52) U.S. Cl.

CPC ..... *G10L 21/0205* (2013.01); *G10L 21/0224* (2013.01); *G10L 21/0232* (2013.01); *G10L 25/21* (2013.01); *G10L 2021/02082* (2013.01)

(58) Field of Classification Search

CPC ..... G10L 21/02; G10L 21/00; G10L 21/0208; G10L 21/0224; G10L 21/0232; G10L 21/0332; G10L 21/06; G10L 19/028; G10L 19/00; G10L 19/03; G10L 19/04; G10L 19/26

USPC ..... 704/200, 203, 210, 2, 219, 226, 233

See application file for complete search history.

(56) References Cited

U.S. PATENT DOCUMENTS

2010/0211382 A1* 8/2010 Sugiyama ..... H04B 3/23 704/205
2016/0240210 A1* 8/2016 Lou ..... G10L 21/0232
2017/0295445 A1* 10/2017 Christoph ..... H04S 7/306

* cited by examiner

*Primary Examiner* — Qi Han

(57) ABSTRACT

A method, a device, and a non-transitory storage medium are described in which a power of late reverberation of a speech signal is estimated based on early samples of the speech signal. The power of the late reverberation may be subtracted linearly or non-linearly from the speech signal.

20 Claims, 17 Drawing Sheets

AUDIO PROCESSING FOR SPEECH

BACKGROUND

Various end devices may operate based on receiving voice input from users. As an example, an end device may be usable as a hands-free device based on receiving commands or natural language speech from the user. The end device may include speech-to-text logic to process the user's voice and perform a function in accordance with the voice input received.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Nowadays, various end devices include logic to respond to voice input from the user. However, depending on the environment within which the user and the end device reside, the end device may receive voice input not only from the user but also from reflections (e.g., reverberation) of the user's voice that stem from the environment. Also, depending on the distance between the user and the end device, the speech input from reflections may adversely impact the ability of the end device or other device to process the speech input and provide a function in response to the speech input. For example, reverberation may be divided into early and late reverberations, and the late reverberation can increase various error rates (e.g., a speech-to-text error rate, an error rate for speech recognition, an error rate for voice recognition etc.) and degrade the quality of the speech portion of the speech input signal.

According to exemplary embodiments, an audio processing service for speech is described. According to an exemplary embodiment, an estimated late reverberation is calculated and used for linear subtraction. According to another exemplary embodiment, an estimated late reverberation is calculated and used for non-linear subtraction. According to an exemplary embodiment, an adaptive filtering error signal is used for updating an adaptive filter. According to an exemplary embodiment, segments of a speech signal that include stronger late reverberation are estimated based on decay moments. In view of the foregoing, various error rates and the degradation of the speech portion of a speech input signal may be minimized.

Figure 1:
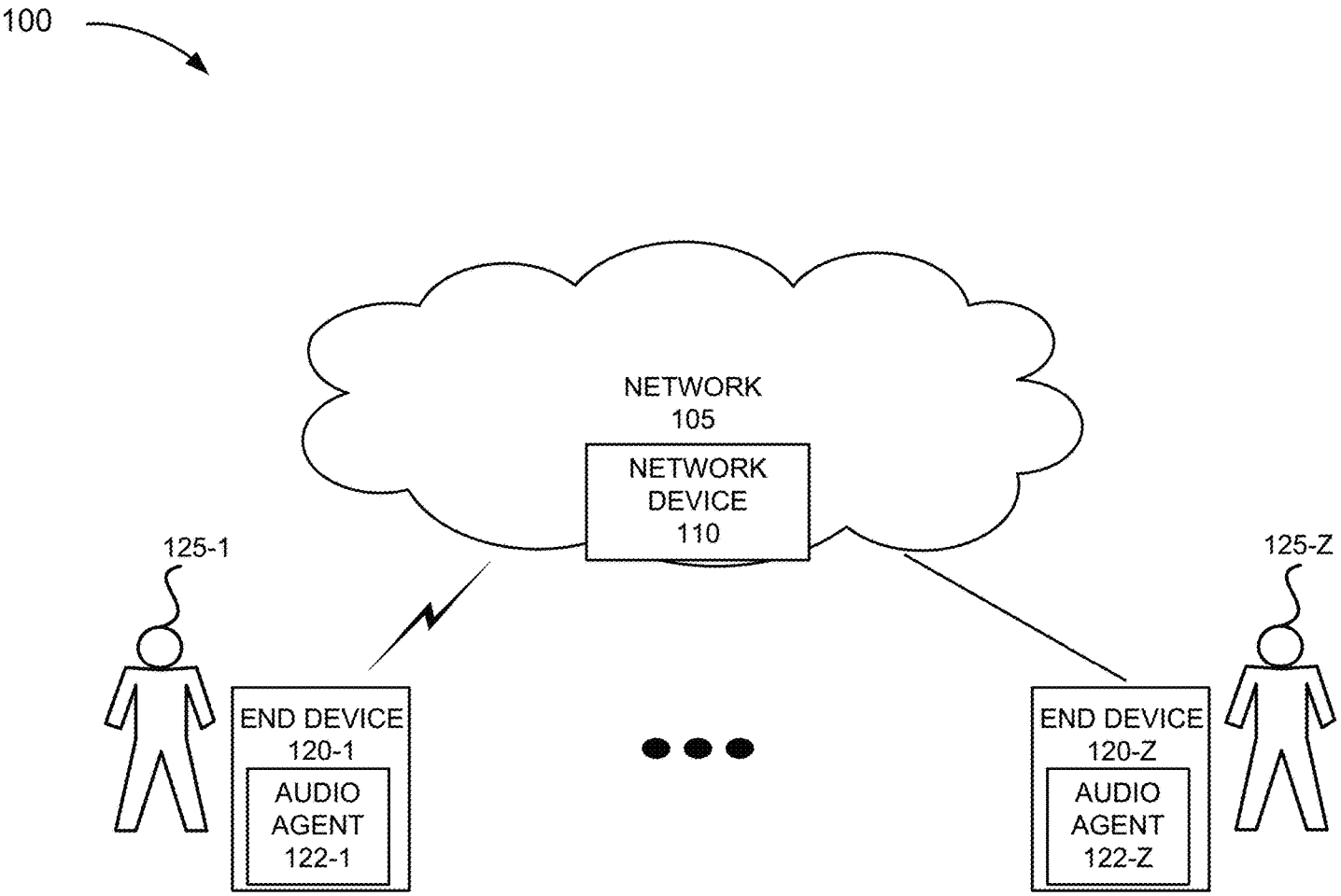
FIG. 1 is a diagram illustrating an exemplary environment in which an exemplary embodiment of an audio processing for speech service may be implemented.

FIG. 1 is a diagram illustrating an exemplary environment 100 in which an exemplary embodiment of an audio processing service may be implemented. As illustrated, environment 100 includes a network 105 that includes a network device 110. Also, environment 100 includes end devices 120-1 through 120-Z (also referred to collectively as end devices 120 and, individually or generally as end device 120). End devices 120 include audio agents 122-1 through 122-Z ((also referred to collectively as audio agents 122 and, individually or generally as audio agent 122). End devices 120 may be operated by users 125-1 through 125-Z (also referred to collectively as users 125 and, individually or generally as user 125). According to other embodiments, environment 100 may include additional, fewer, and/or different types of networks and/or devices than those illustrated and described herein. For example, according to other exemplary embodiments, environment 100 may not include network 105 and network device 110.

Environment 100 includes communication links between network 105 and end device 120. Environment 100 may be implemented to include wired, optical, and/or wireless communication links among end device 120 and network 105, as illustrated. A communicative connection via a communication link may be direct or indirect. For example, an indirect communicative connection may involve an intermediary device and/or an intermediary network not illustrated in FIG. 1. The number and the arrangement of communication links illustrated in environment 100 are exemplary.

A device may be implemented according to a centralized computing architecture, a distributed computing architecture, or a cloud computing architecture (e.g., an elastic cloud, a private cloud, a public cloud, etc.). Additionally, a device may be implemented according to one or multiple network architectures (e.g., a client device, a server device, a peer device, a proxy device, and/or a cloud device).

Network 105 includes one or multiple networks of one or multiple types. For example, network 105 may be implemented to include a terrestrial network, a wireless network, a wired network and/or an optical network. For example, network 105 may include a radio access network (RAN), such as a Third Generation (3G) RAN, a 3.5G RAN, a Fourth Generation (4G) RAN, a 4.5G RAN, or a future generation RAN (e.g., a Fifth Generation (5G) RAN). Network 105 may also include other types of networks, such as a WiFi network, a Worldwide Interoperability for Microwave Access (WiMAX) network, a local area network (LAN), a personal area network (PAN), or other type of network that provides access to or can be used as an on-ramp to network 105 and/or network device 110. Network 105 may include a complementary network pertaining to the one or multiple RANs described. For example, network 105 may include a core network, such as the core part of a Long Term Evolution (LTE) network or an LTE-Advanced network (e.g., an evolved packet core (EPC) network), a Code Division Multiple Access (CDMA) core network, a Global System for Mobile Communications (GSM) core network (e.g., a network switching subsystem (NSS)), a 5G core network, and so forth. Network 115 may also be implemented to include a service or an application-layer network, the Internet, the World Wide Web, an Internet Protocol Multimedia Subsystem (IMS) network, a Rich Communication Service (RCS) network, a cloud network, a packet-switched network, a private network, a public network, a telecommunication network, an IP network, or some combination thereof.

Network device 110 includes a device that has computational and communication capabilities. According to an exemplary embodiment, network device 110 includes logic that receives speech data from end device 120 and converts the speech data to text. Network device 110 includes logic that transmits the text to end device 120. End device 120 may perform a function based on the text received from network device 110. As previously described, according to other embodiments, network device 110 may be omitted and end device 120 may perform speech-to-text conversion.

End device 120 includes a device that has computational and communication capabilities. End device 120 may be implemented as a mobile device, a portable device, or a stationary device. End device 120 may be implemented as a Machine Type Communication (MTC) device, an Internet of Things (IoT) device, an enhanced MTC device (eMTC) (also known as Cat-M1), a NarrowBand IoT (NB-IoT) device, a machine-to-machine (M2M) device, a user device, or some other type of end node. By way of further example, end device 120 may be implemented as a smartphone, a personal digital assistant, a tablet, a netbook, a phablet, a wearable device, a set top box, an infotainment system in a vehicle, a smart television, a game system, a music playing system, or some other type of user device. According to some exemplary embodiments, end device 120 may include a peripheral device. For example, the peripheral device may be implemented as a microphone. According to various exemplary embodiments, end device 120 may be configured to execute various types of software (e.g., applications, programs, etc.). The number and the types of software may vary from one end device 120 to another end device 120. End device 120 includes audio agent 122 that provides the audio processing service, as described herein.

Figure 2:
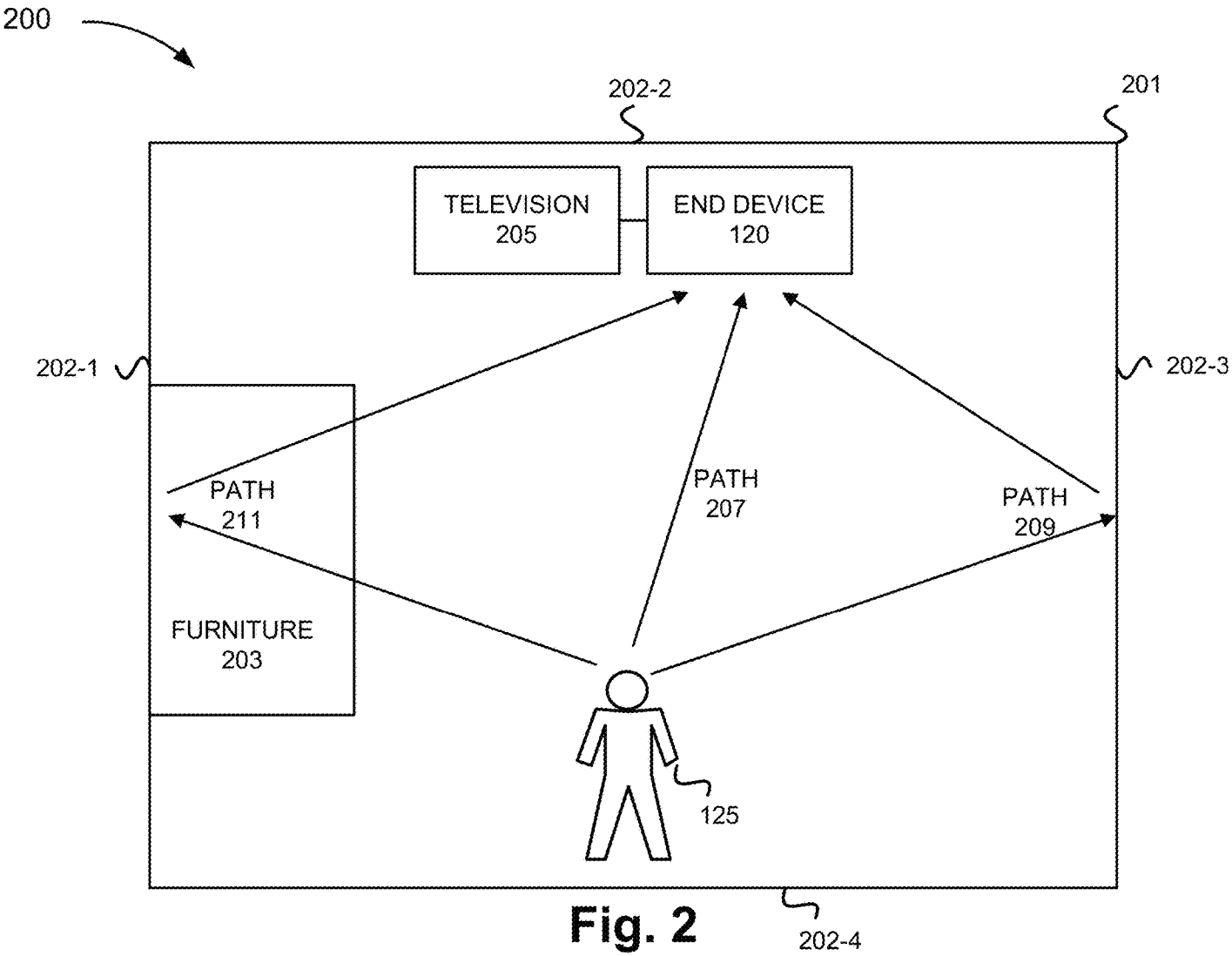
FIG. 2 is a diagram illustrating an exemplary environment in which reverberation may occur.

FIG. 2 is a diagram of an exemplary environment in which reverberation may occur. As illustrated, an indoor environment 200 may correspond to a room 201 having walls 202-1 through 202-4. Although not illustrated, room 201 includes a ceiling. Additionally, room 201 may include furniture 203, as well as other objects not illustrated (e.g., a rug, curtains, pictures, etc.). According to this example, user 125 may operate a television 205 via end device 120. For example, user 125 may change channels or perform other functions associated with watching television 205 by speaking to end device 120. When user 125 speaks (e.g., a voice command or natural language) to end device 120, end device 120 may receive the speech from multiple paths. For example, a path 207 may be considered a direct path or coupling having the shortest distance between user 125 and end device 120. Based on the shortest distance, path 207 may yield the shortest delay and the least attenuation of speech received by end device 125. That is, the delay is the time for the voice to travel from user 125 to end device 120, and the attenuation is the decay of the sound wave (e.g., reduction in amplitude) while propagating through the air over the distance. Additionally, as illustrated, end device 120 receives the user's speech from a path 209 and a path 211, which are reflections (e.g., a reflection from wall 202-3 and a reflection from furniture 203). End device 120 may receive the speech from paths 209 and 211 in which each path may yield its own (and different) delay and attenuation because of the nature of the path (e.g., reflection angles, object absorption, distance in path, etc.). Also, although not illustrated, end device 120 receives speech from other paths, each of which has their own characteristics (e.g., delay, attenuation, interference, etc.).

As a result, FIG. 2 illustrates that end device 120 can receive multiple reflections of the user's voice in which each reflection may have different characteristics, in addition to the direct coupling of the user's voice (e.g., path 207). However, speech recognition is reduced with the increase of reverberation. Therefore, reverberation should be cancelled or significantly reduced.

Figure 3A:
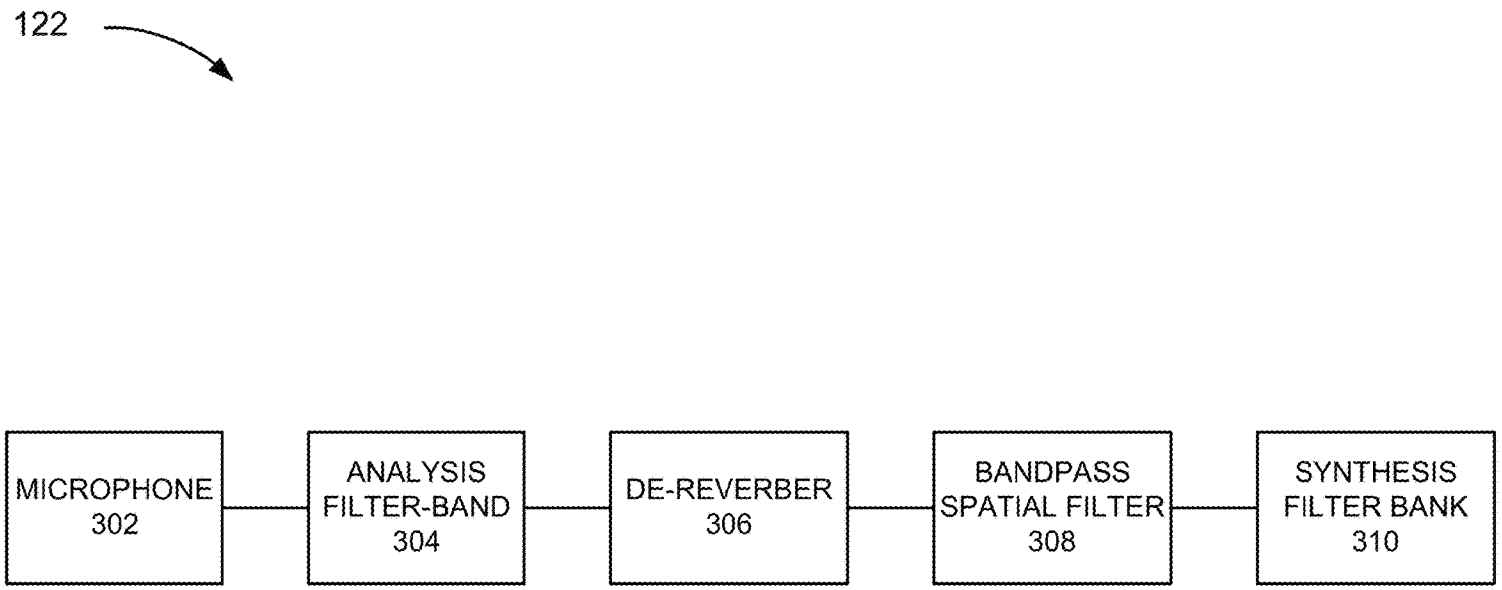
FIG. 3A is a diagram illustrating exemplary components of an exemplary embodiment of an audio agent depicted in FIG. 1.
Figure 3B:
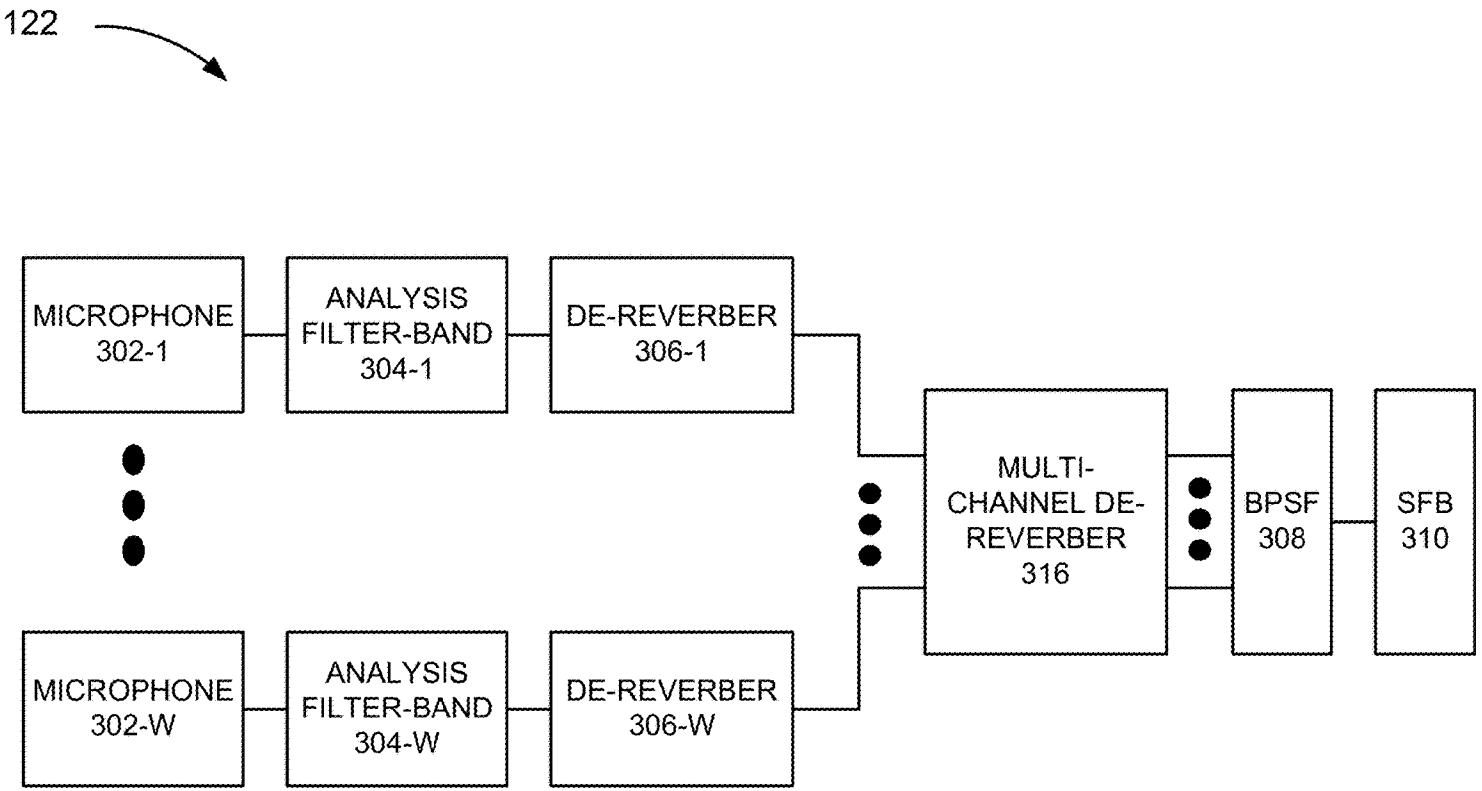
FIG. 3B is a diagram illustrating exemplary components of another exemplary embodiment of the audio agent depicted in FIG. 1.

FIGS. 3A and 3B are diagrams illustrating exemplary components of embodiments of audio agent 122. For example, FIG. 3A illustrates an exemplary embodiment of audio agent 122 when audio agent 122 includes a single microphone. In contrast, FIG. 3B illustrates an exemplary embodiment of audio agent 122 when audio agent 122 includes multiple microphones (e.g., where W>1) and a multi-channel de-reverber, as described herein.

Referring to FIG. 3A, audio agent 122 includes a microphone 302, an analysis filter-band (AFB) 304, a de-reverber 306, a bandpass spatial filter (BPSF) 308, and a synthesis filter bank (SFB) 310. According to other exemplary embodiments, audio agent 122 may include additional, different, and/or fewer components. For example, audio agent 122 may include a speech recognition component or a speech-to-text component, as described further below. According to another example, while end device 120 may include one or multiple microphones, the microphone may not be considered a part of audio agent 122. The connections between the components are exemplary. Additionally, the number of connections between components is exemplary.

Microphone 302 includes a transducer that converts sound to an electrical signal. Depending on the type of microphone 302, various characteristics of microphone 302 may be different, such as polar pattern, frequency response, sensitivity, and so forth.

Analysis filter-band 304 includes logic that transforms a time domain signal received from microphone 302 to joint time and frequency domain signals. In the frequency domain at a time instance, analysis filter-band 304 outputs a set ofM signals generated via a set of M complex bandpass filters covering a bandwidth of the signal, and down-sampled by a factor less than 2M. The bandwidth of each bandpass filter may be the same or different. Additionally, the total bandwidth of the bandpass filters is configurable, but necessarily includes the frequency spectrum of the human voice.

The sampling rate ($f_s$) used is typically higher than twice the bandwidth of the speech signal. As an example, the sampling rate of a human voice signal may be about 16,000

Hertz (Hz) when the bandwidth allotted for the human voice signal is about 8,000 kHz. However, the signal energy of speech is concentrated in a narrow frequency band and the remaining frequency bands may have little energy in comparison, which is not a suitable input for most adaptive filtering algorithms. In contrast, the output of analysis filter-band 304 is a wideband signal in its bandwidth, which may increase performance of many adaptive filtering algorithms, such as normalized least mean squared (NLMS) and recursive least square (RLS) algorithms.

De-reverber 306 includes logic that performs de-reverberation to the signal output by analysis filter band 304. For purposes of description, de-reverberation means removing or reducing late reverberation. According to an exemplary embodiment, de-reverber 306 performs de-reverberation based on an estimate of late reverberation. The estimate of late reverberation may be calculated using an adaptive filtering algorithm. The adaptive filtering algorithm estimates the late reverberation based on an early microphone signal, a current microphone signal, and/or a late or ahead microphone signal.

As previously described, reverberation may be separated or characterized into early reverberation and late reverberation. According to exemplary implementation, the characterization may be based on the delay time associated with a reflection. For example, assuming that direct coupling time is less than around a few milliseconds or so (and if not, to cut leading delay to about a few milliseconds), a time T may be defined as a threshold value, in which a reflection having an arrival time equal to or less than time T may be characterized as early reverberation, and a reflection having an arrival time greater than time T may be characterized as late reverberation. The direct or non-reflection signal (e.g., path 207 of FIG. 2) is characterized as an early reverberation. As an example, the time T may have a value of about 40 milliseconds (ms) up to a value of about 60 ms, or some other user-configurable time value. As previously described, late reverberation may negatively impact speech recognition or speech-to-text. Also, the ratio of early reverberation to late reverberation may determine the performance of speech recognition or speech-to-text. For example, when the ratio is high, the performance may yield more accurate results compared to when the ratio is low (e.g., below 1). When speech is not correctly recognized, a recognition error occurs. The ratio of the number of word recognition errors to the total number of words is known as word error rate (WER), and the ratio of the number of sentence recognition errors to the total number of sentences is known as sentence error rate (SER). The hit rate may be defined as one minus the error rate.

De-reverber 306 includes logic that performs late reverberation subtraction based on the estimated late reverberation. The late reverberation subtraction performed may be linear or non-linear. For example, when the subtraction is linear, the late reverberation may be a linear combination of early samples in the output of analysis filter band 304. When the subtraction is non-linear, the subtraction may be logarithmic or other non-linear manner. For example, late reverberation may be calculated as a weighted sum of early samples with absolute values or the square of absolute values. Early samples may be defined as the samples before early reverberation time.

De-reverber 306 includes logic that estimates segments where there is almost no target signal or less target signal. According to an exemplary implementation, de-verber 306 includes logic that calculates a variable or soft indicator that has a value from 0 to 1. A value of 0 indicates that no target signal is present and a value of 1 indicates that no late reverberation is present.

Segments where speech decays may contain less early reverberation and segments where speech decays to silence may contain almost no early reverberation. De-reverber 306 includes logic that estimates these types of segments. According to an exemplary implementation, de-reverber 306 includes logic that identifies signal decay moments and moments when the signal decays to a noise level. According to another exemplary implementation, de-reverber 306 includes logic that computes a normalized correlation between a current signal and certain early signals. When the distance between the current and early signals is large enough, the normalized correlation includes less speech correlation itself. In this regard, the major correlation is the indication of late reverberation.

For linear adaptation, when segments are not in decay, adaptation may be frozen. Also, when the signal is estimated at the beginning of the decay, the adaptation may be applied gradually or slowly. Further, when the noise floor is approaching, adaptation may be applied rapidly. The noise floor for a frequency band may be estimated based on voice activation detection (VAD). When the signal is noise, adaptation may be frozen. According to another exemplary implementation, a variable that may be proportional to the inverse of the noise level may be used to control the adaptation rate.

For non-linear adaptation, in an indoor environment (e.g., a room, etc.), the impulse response for the indoor environment may be assumed to be an exponential decay random signal, and the segments of speech from microphone 302 that decay to the noise level may be similar to the impulse response. Based on these segments, late reverberation may be estimated, as described herein.

De-reverber 306 may be implemented with any one of various adaptation algorithms, such as Kalman filtering, recursive least square (RLS), normalized least mean square (NLMS), or another type of adaptation algorithm. Depending on the adaptation algorithm used, the adaptation algorithm may be better or worse relative to other adaptation algorithms in terms of various metrics, such as convergence rate, residual error, computational complexity, step-size parameter, and so forth.

Reverberation model parameters are estimated on those segments for non-linear subtraction of late reverberation. For linear subtraction, late reverberation adaptive filter is updated on those segments. Voice activation detection may be used to freeze adaptation during noise segments.

Figure 3C:
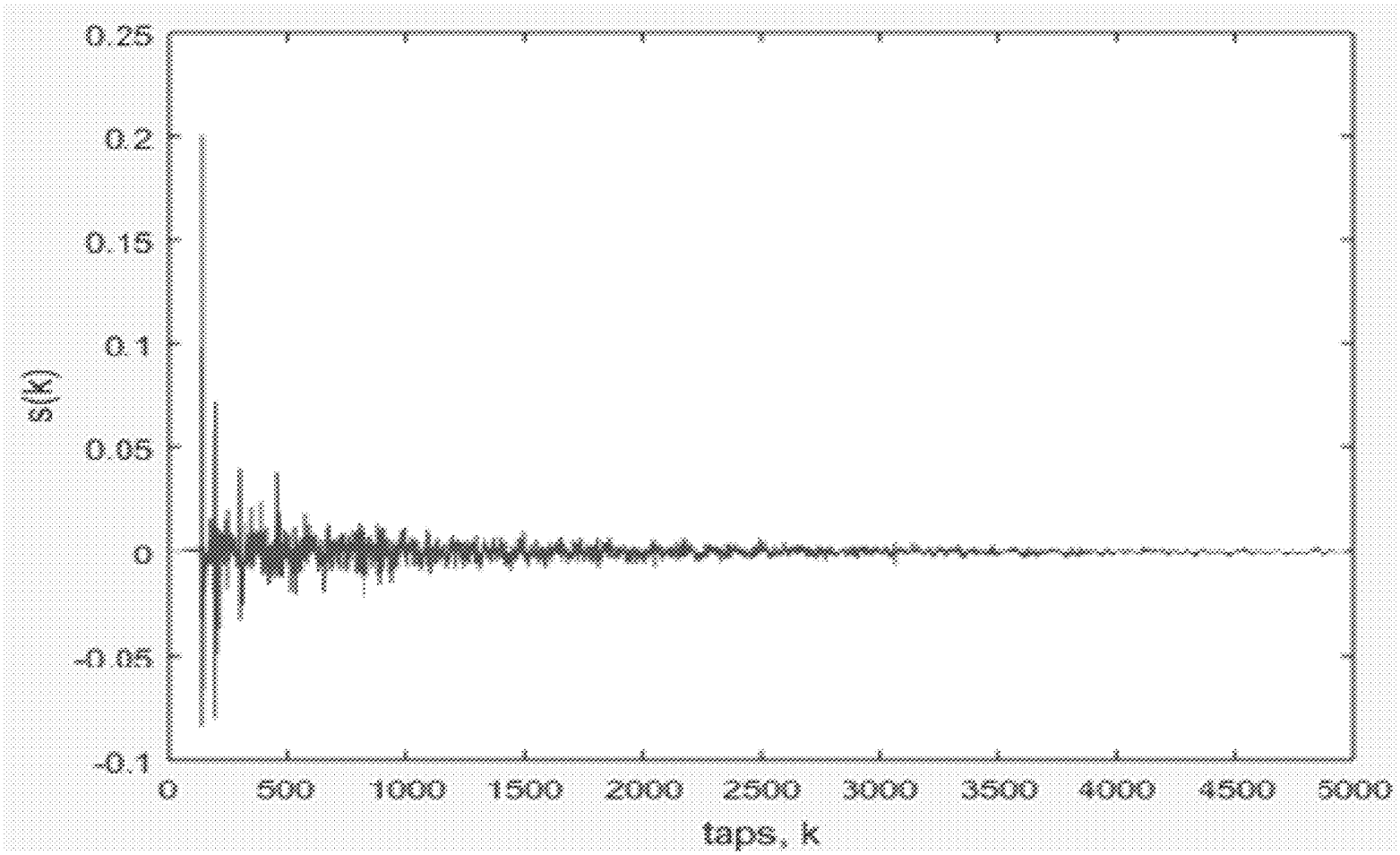
FIG. 3C is a diagram illustrating an exemplary measured impulse response.

Let x(n) be a discrete-time voice signal spoken by a user (e.g., user 125) where n is the time index, and the signal received by a microphone (e.g., microphone 302) is modeled as y(n) according to the following exemplary expression:

$$y(n)=\Sigma_{k=0}^{\infty}s(k)x(n-k) \quad (1),$$

in which s(k) is the attenuation at delay k and is defined as a room impulse response (RIR). The variable k is defined as a tap corresponding to a delay. The direct coupling is at $k=k_0$, and $s(k_0)$ is the attenuation of a direct path. With this in mind, s(k) should be zero for all $k<k_0$. However, because the delay may not be at point $k_0$ exactly (e.g., the sampling point may not perfectly align at the delay point), there may be small values at those points. In equation (1), the impulse response has infinite taps. In a typical environment, the value of $s(k_0)$ will get smaller and smaller with the increase of taps. When at a point, the average value around the point is below a direct coupling by a threshold value, the value may be set to zero after this point. This point may be defined as an integer N, and equation (1) may be written according to the following exemplary expression:

$$y(n)=\Sigma_{k=0}^{N-1}s(k)x(n-k) \quad (2),$$

in which integer N can be a point corresponding to a time defined as the reverberation time. For example, the reverberation time may be when a reflection is below the direct coupling by the threshold value. By way of further example, the reverberation time may be when a reflection is below the direct coupling by a threshold decibel value (e.g., about 60 dB or some other numerical value). Referring to FIG. 3C, as an example, a measured impulse response may include 5000 taps, in which the first strong one corresponds to the direct coupling between end device 120 and user 125 (e.g., the speech of user 125).

As previously described, reverberation may be separated into early reverberation and late reverberation, and a threshold time value T may be used. Let L represent the number of taps. Therefore, equation (2) may be rewritten according to the following exemplary expressions:

$$y(n)=\Sigma_{k=0}^{L-1}s(k)x(n-k)+\Sigma_{k=L}^{N-1}s(k)x(n-k) \quad (3)$$

$$y(n)=y_e(n)+y_l(n) \quad (4),$$

in which variable $y_e(n)=\Sigma_{k=0}^{L-1}s(k)x(n-k)$ is a portion of the microphone signal corresponding to early reverberation including the direct coupling, and variable $y_l(n)=\Sigma_{k=l}^{N-1}s(k)x(n-k)$ is the remaining portion of the microphone signal corresponding to late reverberation.

When considering equation (4) as a time signal for a narrowband centered at a frequency, it may be assumed that early reverberation and late reverberation are uncorrelated. By using an expectation operation, and the squaring of both sides, equation (4) may be transformed into the following exemplary expression:

$$P(n)=P_e(n)+P_l(n) \quad (5).$$

In the exemplary equation (4), $P(n)=E\{|y(n)|^2\}$, $P_e(n)=E\{|y_e(n)|^2\}$, and $P_l(n)=E\{y_l(n)|^2\}$, in which $E\{X\}$ is the expectation operation to X and can be estimated as an average of X.

If $P_e(n)$ is available, a weight may be calculated according to the following expression:

$$w(n)=\left[\frac{P_e(n)}{P(n)}\right]^{\mu}=\left[\frac{P(n)-P_l(n)}{P(n)}\right]^{\mu}=\left[1-\frac{P_l(n)}{P(n)}\right]^{\mu}, \quad (6)$$

in which w(n) represents a weight, and μ is a real number that may have a value between 0 and 1.

Using the weight in equation (6), an output after de-reverberation may be calculated according to the following exemplary expression:

$$\hat{y}_e(n)=w(n)y(n) \quad (7),$$

in which $\hat{y}_e(n)$ is an estimate of $y_e(n)$.

For example, if μ=0.5 and w(n) is considered deterministic, the square of both sides of equation (6) may yield the following result according to the following expressions:

$$E\{|\hat{y}_e(n)|^2\}=w(n)^2E\{|y(n)|^2\}=E\{|y_e(n)|^2\}=P_e(n). \quad (8)$$

Equation (8) shows that the expectation of estimated de-reverberation output via equations (6) and (7) is the expectation of the early reverberation. Thus, if $P^e(n)$ is available, a de-reverberation method based on equations (6) and (7) is provided.

If $P^l(n)$ is available, a weight may be calculated according to the following exemplary expression:

$$w(n)=1-\left[\frac{P_l(n)}{P(n)}\right]^{\mu}. \quad (9)$$

Similar to the derivation of equation (8) with μ=0.5, it may be proven that the expectation of estimated early reverberation is equal to the expectation of the early reverberation. Thus, if $P_l(n)$ is available, a de-reverberation method based on equations (7) and (9) is provided.

However, neither $P_e(n)$ nor $P_l(n)$ may be available. According to an exemplary implementation, the power of late reverberation may be estimated. Late reverberation may be estimated from early samples, although the estimated coefficients may be infinite in length. In order to avoid such difficulty, the power of late reverberation may be estimated as the power of the microphone signal at an early time, which may be expressed according to the following exemplary expression:

$$P_l(n)=u(n)P(n-Q) \quad (10).$$

In equation (10), u(n) is an adaptive filter via a nonlinear updating. If u(n) is known, late reverberation may be calculated according to this equation and the weight to estimate early reverberation may be calculated according to equation (9). Variable u(n), however, may not be known, but may be estimated.

Variable u(n) may be approximated via modeling a measured indoor impulse response and estimating its parameter. For example, referring to FIG. 3C, a measured room impulse response (RIR) is illustrated, in which s(k) stands for attenuation at delay k. So, if the direct coupling occurs at $k=k_0$, $s(k_0)$ indicates the attenuation of the direct path. Thus, s(k) should be zero for all $k<k_0$. However, because the delay may not be exactly at point $k_0$ (i.e., the sampling point is not perfectly at the delay point), there may be small values at those points. The RIR illustrated in FIG. 3C can be modeled as an inner product of a random variable and a deterministic exponential function for the purpose of estimating the weight, as provided according to the following exemplary expression:

$$s(k)=r(n)e^{-ak} \quad (11),$$

in which r(n) is a random variable. According to an exemplary implementation, a uniform random variable with values between 1 and −1 may be used. Constant α may determine a decay rate of the RIR, which is a function of frequency and the environment where the RIR is generated, and may be calculated via the RIR measured from a room. Suppose that k=Q corresponds to the time between early and late reverberation, the RIR from a first tap to a tap Q may be responsible for the early reverberation. The total energy of the RIR may be expressed according to the following exemplary expression:

$$P_{st}=\sum_{k=0}^{\infty}|r(k)|^2e^{-2ak} \quad (12)$$

$$\approx\sum_{k=0}^{\infty}e^{-2ak} \quad (13)$$

$$=\frac{1}{1-e^{-2a}}.$$

The energy of the RIR responsible for late reverberation may be expressed according to the following exemplary expression:

$$P_{sl} = \sum_{k=Q}^{\infty} |r(k)|^2 e^{-2ak} \tag{14}$$

$$\approx \sum_{k=Q}^{\infty} e^{-2ak} \tag{15}$$

$$= \frac{e^{-2aQ}}{1 - e^{-2a}}.$$

The estimated coefficient may be calculated according to the following exemplary expression:

$$u(n) = \frac{P_{sl}}{P_{st}} = e^{-2aQ}. \tag{16}$$

In summary, a prediction coefficient may be computed based on equation (16) to predict late reverberation according to equation (10). The early reverberation may be estimated based on equations (7) and (9).

However, the RIR may not be known. Additionally, even when the RIR is known, the value of the RIR in the same room may vary depending on the relative position between user 125 and end device 120. In this regard, one measurement of the RIR may be limited in use. In order to estimate u(n) in real-time, information from the input may be extracted in real-time. A definition for an impulse response of a system is to measure the output of the system when a pulse signal is used as an input. A segment of the input during a time when speech has stopped may have a shape similar to the RIR. However, this segment of the input probably contains late reverberation and has a shape similar to the RIR.

Suppose that a segment similar to the RIR is determined, and the envelope of the power at any point of the segment is $P(n)=e^{-2an}$, where n is a time index. If a later point is selected at n+Q, then its power is P(n+Q), and is equal to $e^{-2a(n+Q)}$. The ratio of powers at these two points may be defined as RA and may be expressed as:

$$RA=e^{-2aQ}=u(n) \tag{17}$$

Based on equation (16), late reverberation may be estimated via a power ratio of input at the late reverberation only segment. Since the ratio is known and Q is known, the constant $\alpha$ in $e^{-2aQ}$ may be determined for other uses.

The use of two points to compute u(n) based on equation (16) may be insufficient. The decay segment of input may be determined from an ending at silence or noise level. Suppose that the segment is z(n) and the length of the segment is N and N>Q, the prediction coefficient for estimating the late reverberation may be calculated according to the following exemplary expression:

$$u(n) = \frac{\sum_{k=Q}^{N} |z(k)|^2}{\sum_{k=0}^{N} |z(k)|^2}. \tag{18}$$

For nonlinear adaptation, a variable weight may be used to estimate early reverberation. This requires predicting the late reverberation. The estimate of the variable weight depends on the estimate of late reverberation power and late reverberation is determined as the prediction from early samples of input. In the above, three methods to estimate prediction coefficient are described. The first may be based on the available RIR via equation (16), the second may be based on the available late reverberation segment of the input in which the prediction coefficient may be the power ratio of two points that are apart with a distance of Q (equation (17)), and the third may also be based on the available late reverberation segment in which all segment points may be used in the estimate (equation (18)).

Nonlinear adaptation may be simpler but may distort speech if the estimate error is high. In order to avoid the distortion, a linear adaptation may be preferred. According to linear adaptation, late reverberation may be estimated and subtracted from the input. When the adaptive filtering algorithm converges, the late reverberation may be reduced while early reverberation may be maintained.

The power of the late reverberation may be predicted based on the power of early samples. The prediction coefficient may be estimated with the segment of input where the major component is the late reverberation. Late reverberation samples may be predicted based on early samples. For example, an adaptive filter with length L may be used to predict the late reverberation with samples before current sample by Q samples according to the following exemplary expression:

$$\hat{y}_l(n)=\Sigma_{k=0}^{L-1} h(n, k)y(n-k-Q) \tag{19}$$

The early reverberation may be estimated based on the following exemplary expressions:

$$\hat{y}_e(n) = y(n) - \hat{y}_l(n) \tag{20}$$

$$= y_e(n) + y_1(n) - \hat{y}_l(n) \tag{21}$$

$$= y_e(n) + e_l(n). \tag{22}$$

In equation (22), $e_l(n)=y_l(n)-\hat{y}_l(n)$ is the residual late reverberation. Once an adaptive filtering algorithm used to update the adaptive filter converges, $e_l(n)$ approaches to zero. The output is therefore the early reverberation.

An adaptive filter h(n) should be updated with a fast convergence rate because the RIR may vary over time. The adaptive filter may be updated based on an error signal $\hat{y}_e(n)$ of equation (22). However, the output signal of equation (22) contains a target signal $y_e(n)$ that may be larger than the late reverberation. Accordingly, it may not be optimal to use any adaptive filtering algorithm to update the adaptive filter based on the error signal value of equation (22) and yield a good convergence rate.

Regardless of the adaptive filtering algorithm used, the target signal $y_e(n)$ should be smaller than $e_l(n)$ of equation (22) in order for the algorithm to converge fast. Given that, the segments of input where this condition is true may be estimated. Using techniques similar to those used for nonlinear adaptation, the segment where speech segment is dominant with the late reverberation may be estimated, and the adaptive filter may be updated according to the following exemplary expression:

$$h(n,k)=h(n-1, k)+k(n)\hat{y}_e(n) \tag{23}$$

According to this example, the majority of $\hat{y}_e(n)$ is $e_l$ (n). Therefore, a larger k(n) may be used in equation (23) to make the adaptive filtering algorithm converge faster.

A normalized least mean square (NLMS) algorithm may be used, which may be expressed as:

$$k(n)=\alpha(n)Y(n)/P(Y) \quad (24),$$

in which $\alpha(n)$ is an adaptation step size, $Y(n)=[y(n-Q), y(n-Q-1), \ldots, y(n-Q-L+1)]^H$, $P(Y)=Y^HY+\delta(\ )^H$ is a Hamilton transverse operation, and $\delta$ is a small constant.

The adaptation step may be controlled via the late reverberation dominant segment. When it is not the segment, it is zero. When the segment starts, a variable may be used, such as $\alpha(n)$. It may also be a variable step size, as indicated according to the following exemplary expression:

$$\alpha(n)=\begin{cases} K*\dfrac{P_n(n)}{P(n)}, & P(n)>TH*P_n(n) \\ 0, & P(n)\le TH*P_n(n) \end{cases}. \quad (25)$$

In equation (25), $P_n(n)$ is noise power, K is less than one, and TH is greater than one. This rule may reduce adaptation speed at the beginning of the segment because more early reverberation may be included here. However, application of this rule may speed up adaptation at the place where the input decays to a noise level.

The noise level may be very high or very low. Thus, the rule expressed in equation (25) may not be robust. According to another exemplary rule, $$\frac{P_n(n)}{P(n)}$$

of equation (25) may be replaced with $1-e^{-2\alpha n}$. Index n=0 may be the beginning of the segment, and $\alpha$ may be estimated based on equation (17) and/or equation (18).

Other rules may also be used for performing adaptive filtering. For example, normalized correlation between current and early samples (e.g., earlier than Q in time) may also provide an indication of the amount of late reverberation. Also, for example, a recursive least square algorithm may be used, according to the following exemplary expressions:

$$k(n)=B(n-1)Y(n)\beta(n) \quad (26)$$

$$\beta(n)=1/[\alpha(n)+Y(n)^HB(n-1)Y(n)] \quad (27)$$

$$B(n)=B(n-1)-k(n)Y(n)^HB(n-1) \quad (28).$$

It should be noted, that unlike an exact RLS algorithm, the forgetting factor in equation (27) is replaced with $\alpha(n)$, and the result of equation (28) is one when it is compared with the standard RLS algorithm.

A linear estimate of the late reverberation and the early reverberation may be obtained based on subtracting the estimated late reverberation linearly. This method may significantly reduce the word error rate. Since it is linear, the distortion due to the algorithm may be smaller. On the other hand, the method depends on the convergence of the algorithm. Since there is target signal in the error signal that is used for updating the adaptive filter, the convergence may be limited. In addition, theoretically, the adaptive filter length must be very long. However, the longer the length of the adaptive filter, the more difficult it may be to attain convergence. Therefore, the length of the adaptive filter may have certain length restrictions.

Bandpass spatial filter 308 includes logic that filters out noise and side-talk. Also, bandpass spatial filter 308 includes logic that estimates the direction of arrival of the speaker's voice (e.g., user 125).

Synthesis filter bank 310 includes logic that combines all frequency bands into a single time domain signal for sending to a post-processing component. For example, the post-processing logic may include a speech recognition component, a speech-to-text component, a voice recognition component, or other type of component that may be used to invoke a functional response by end device 120. Synthesis filter bank 310 includes logic that makes sure that information included in the original microphone signal is not lost due to the processing by other components of audio agent 122. For example, synthesis filter bank 310 may include logic that compares the input signal to the output signal to determine whether information is lost or not.

Referring to FIG. 3B, as previously described, includes multiple components of the same type, such as microphone 302, analysis filter band 304, and de-reverber 306. In addition, audio agent 122 of FIG. 3B includes bandpass spatial filter 308 and synthesis filter bank 310. These components have been previously described and may operate in a manner similar to that previously described. However, as illustrated, audio agent 122 of FIG. 3B includes multi-channel de-reverber 316. Mult-channel de-reverber 316 includes logic that applies a normalized cross-correlation to the signals received from de-reverbers 306, which may filter the signals and weight down late reverberation. For example, early reverberation may have a strong correlation among microphone signals, and late reverberation may have less or no correlation among the microphone signals.

Figure 4:
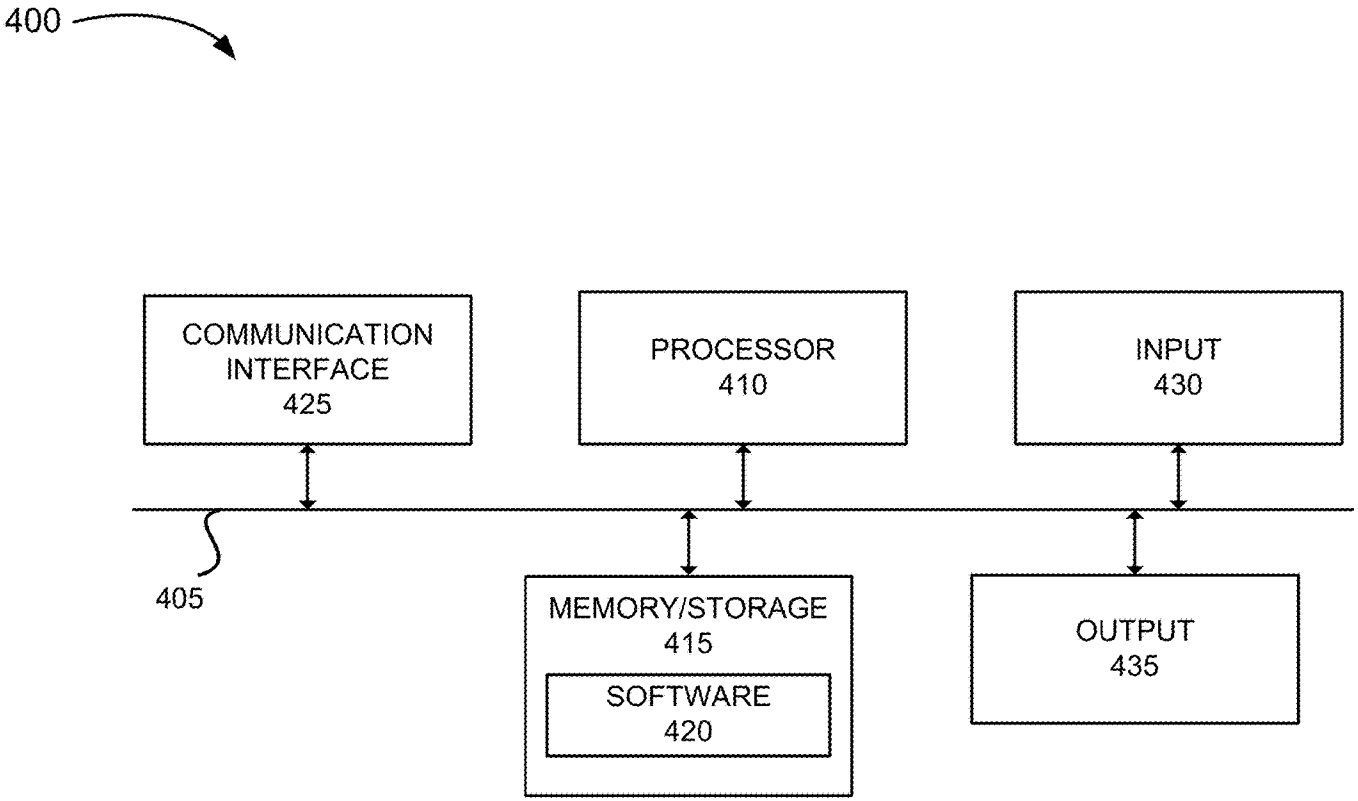
FIG. 4 is a diagram illustrating exemplary components of a device that may correspond to one or more of the devices illustrated herein.

FIG. 4 is a diagram illustrating exemplary components of a device 400 that may correspond to one or more of the devices described herein. For example, device 400 may correspond to components included in network device 110 and end device 120. As illustrated in FIG. 4, device 400 includes a bus 405, a processor 410, a memory/storage 415 that stores software 420, a communication interface 425, an input 430, and an output 435. According to other embodiments, device 400 may include fewer components, additional components, different components, and/or a different arrangement of components than those illustrated in FIG. 4 and described herein.

Bus 405 includes a path that permits communication among the components of device 400. For example, bus 405 may include a system bus, an address bus, a data bus, and/or a control bus. Bus 405 may also include bus drivers, bus arbiters, bus interfaces, clocks, and so forth.

Processor 410 includes one or multiple processors, microprocessors, data processors, co-processors, application specific integrated circuits (ASICs), controllers, programmable logic devices, chipsets, field-programmable gate arrays (FPGAs), application specific instruction-set processors (ASIPs), system-on-chips (SoCs), central processing units (CPUs) (e.g., one or multiple cores), microcontrollers, and/or some other type of component that interprets and/or executes instructions and/or data. Processor 410 may be implemented as hardware (e.g., a microprocessor, etc.), a combination of hardware and software (e.g., a SoC, an ASIC, etc.), may include one or multiple memories (e.g., cache, etc.), etc.

Processor 410 may control the overall operation or a portion of operation(s) performed by device 400. Processor 410 may perform one or multiple operations based on an operating system and/or various applications or computer programs (e.g., software 420). Processor 410 may access instructions from memory/storage 415, from other components of device 400, and/or from a source external to device 400 (e.g., a network, another device, etc.). Processor 410 may perform an operation and/or a process based on various techniques including, for example, multithreading, parallel processing, pipelining, interleaving, etc.

Memory/storage 415 includes one or multiple memories and/or one or multiple other types of storage mediums. For example, memory/storage 415 may include one or multiple types of memories, such as, random access memory (RAM), dynamic random access memory (DRAM), cache, read only memory (ROM), a programmable read only memory (PROM), a static random access memory (SRAM), a single in-line memory module (SIMM), a dual in-line memory module (DIMM), a flash memory, and/or some other type of memory. Memory/storage 415 may include a hard disk (e.g., a magnetic disk, an optical disk, a magneto-optic disk, a solid state disk, etc.) and a corresponding drive. Memory/storage 415 may include a hard disk (e.g., a magnetic disk, an optical disk, a magneto-optic disk, a solid state disk, etc.), a Micro-Electromechanical System (MEMS)-based storage medium, and/or a nanotechnology-based storage medium. Memory/storage 415 may include drives for reading from and writing to the storage medium.

Memory/storage 415 may be external to and/or removable from device 400, such as, for example, a Universal Serial Bus (USB) memory stick, a dongle, a hard disk, mass storage, off-line storage, or some other type of storing medium (e.g., a compact disk (CD), a digital versatile disk (DVD), a Blu-Ray disk (BD), etc.). Memory/storage 415 may store data, software, and/or instructions related to the operation of device 400.

Software 420 includes an application or a program that provides a function and/or a process. As an example, with reference to end device 120, software 420 may include an application that, when executed by processor 410, provides the functions of the audio processing service, as described herein. Software 420 may also include firmware, middleware, microcode, hardware description language (HDL), and/or other form of instruction. Additionally, for example, software 420 may include an operating system (OS) (e.g., Windows, Linux, Android, etc.).

Communication interface 425 permits device 400 to communicate with other devices, networks, systems, and/or the like. Communication interface 425 includes one or multiple wireless interfaces, optical interfaces, and/or wired interfaces. For example, communication interface 425 may include one or multiple transmitters and receivers, or transceivers. Communication interface 425 may operate according to a protocol stack and a communication standard. Communication interface 425 may include an antenna. Communication interface 425 may include various processing logic or circuitry (e.g., multiplexing/de-multiplexing, filtering, amplifying, converting, error correction, etc.).

Input 430 permits an input into device 400. For example, input 430 may include a keyboard, a mouse, a display, a touchscreen, a touchless screen, a button, a switch, an input port, speech recognition logic, and/or some other type of visual, auditory, tactile, etc., input component. Output 435 permits an output from device 400. For example, output 435 may include a speaker, a display, a touchscreen, a touchless screen, a light, an output port, and/or some other type of visual, auditory, tactile, etc., output component.

Device 400 may perform a process and/or a function, as described herein, in response to processor 410 executing software 420 stored by memory/storage 415. By way of example, instructions may be read into memory/storage 415 from another memory/storage 415 (not shown) or read from another device (not shown) via communication interface 425. The instructions stored by memory/storage 415 cause processor 410 to perform a process described herein. Alternatively, for example, according to other implementations, device 400 performs a process described herein based on the execution of hardware (processor 410, etc.).

Figure 5A:
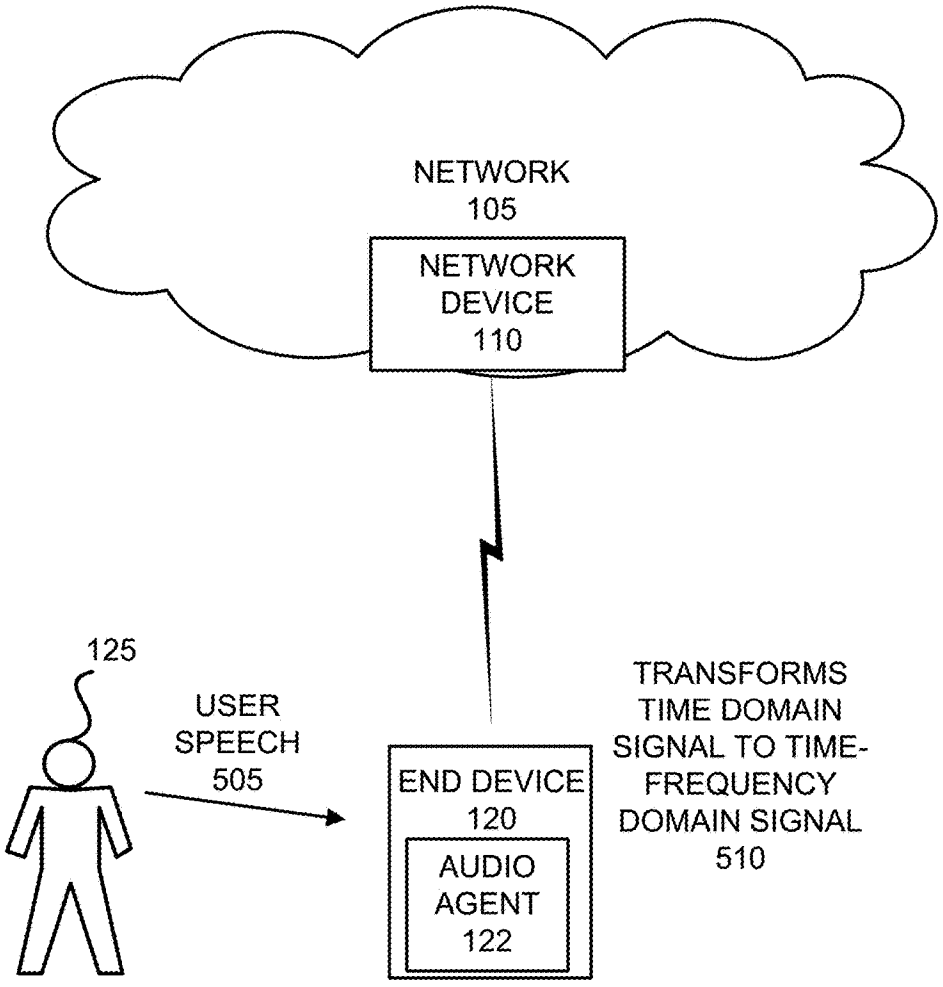
FIGS. 5A -5D are diagrams illustrating an exemplary process of the audio processing for speech service according to an exemplary scenario.
Figure 5B:
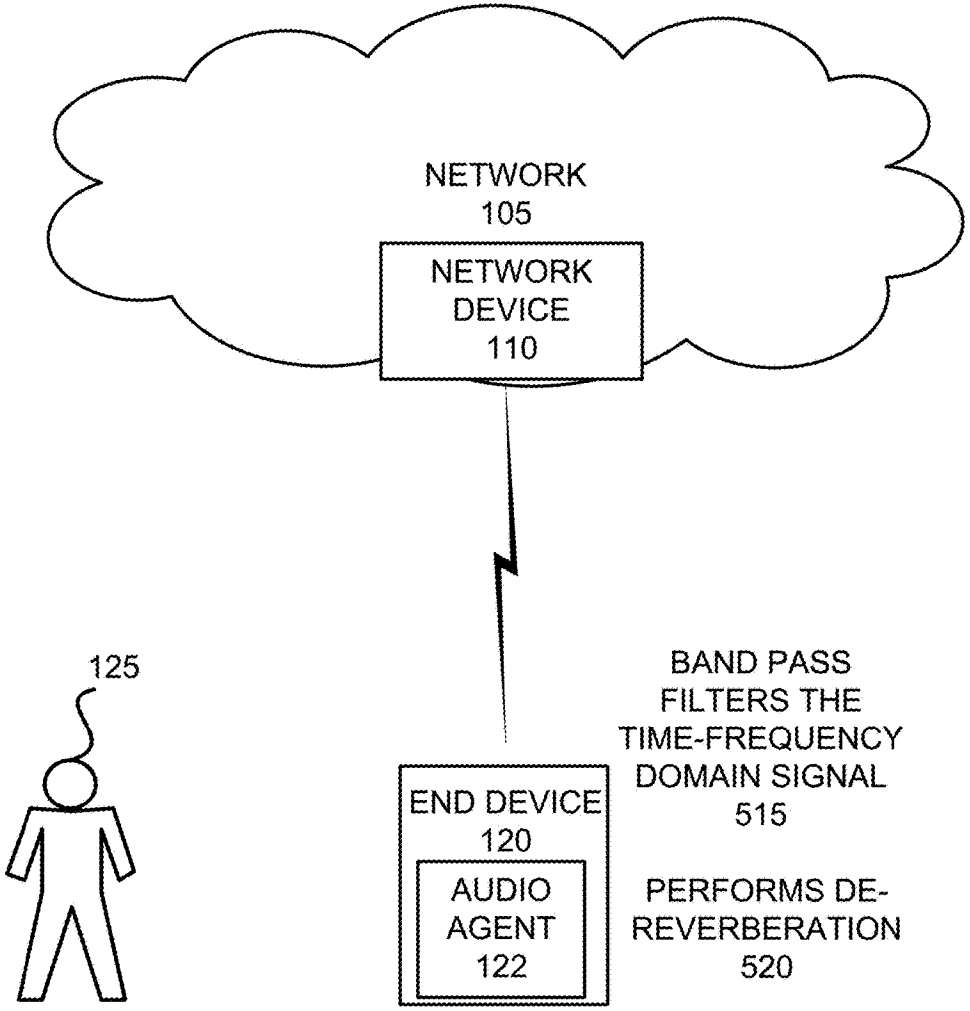
Figure 5C:
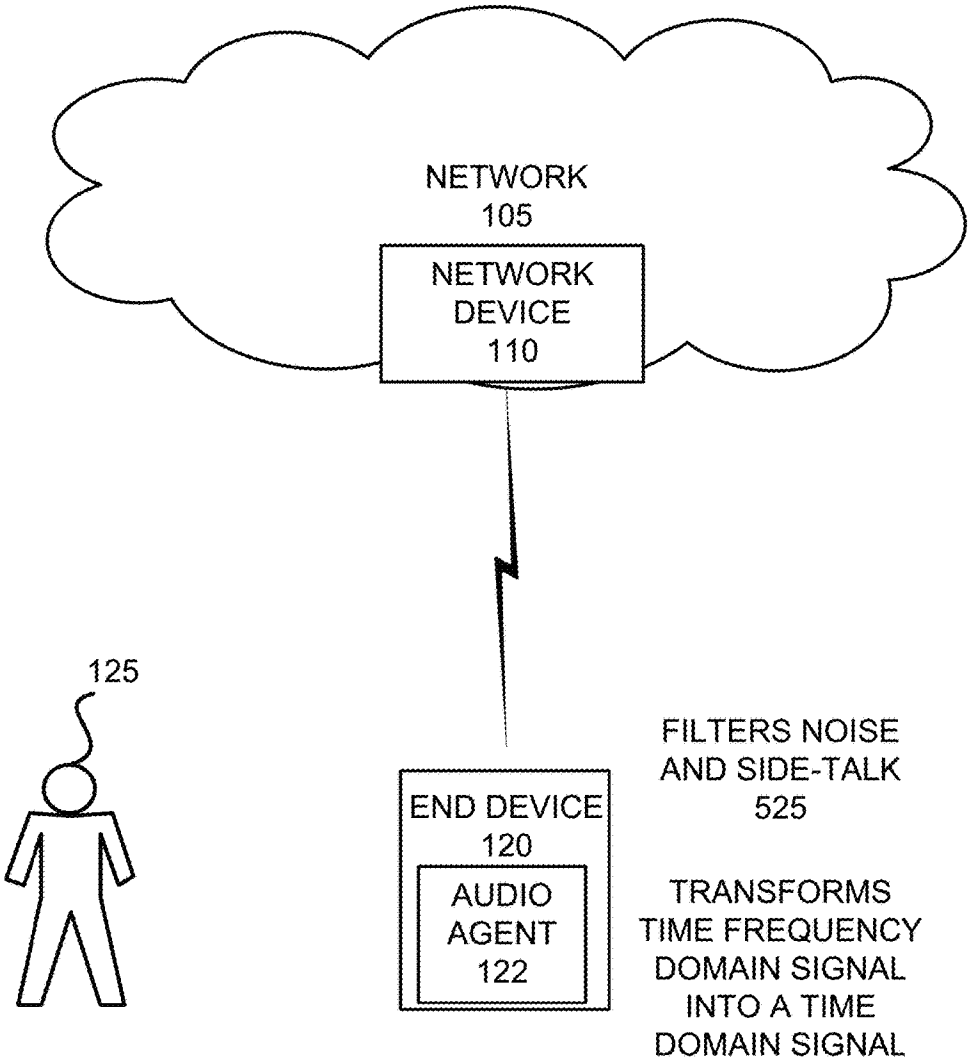
Figure 5D:
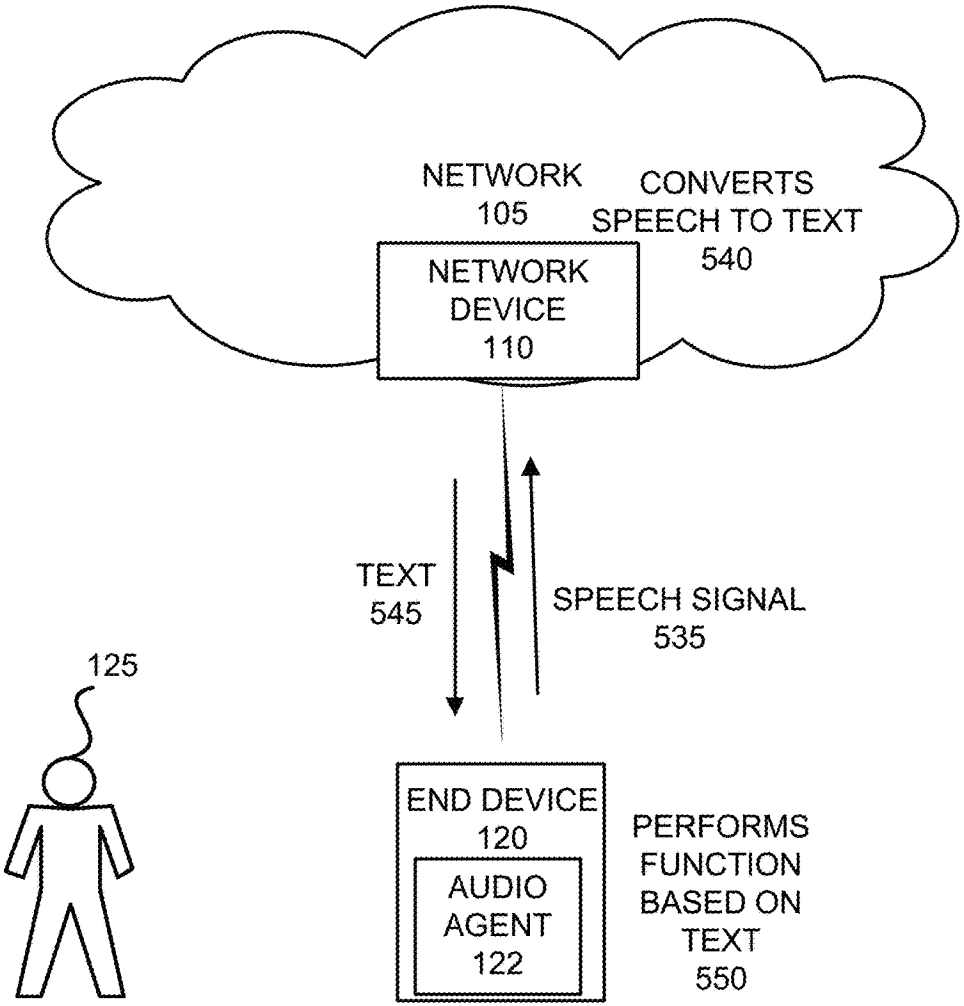

FIGS. 5A-5D are diagrams illustrating an exemplary process of the audio processing service according to an exemplary scenario. Referring to FIG. 5A, user 125 speaks to end device 120 such that user speech 505 is received by microphone 302 of audio agent 122. Subsequently, AFB 304 of audio agent 122 transforms the time-domain audio signal to joint time-frequency domain signals 510. Referring to FIG. 5B, AFB 304 band pass filters the time-frequency domain signals 515. De-reverber 306 of audio agent 122 receives the time-frequency domain signals and performs de-reverberation 520, as described herein. The de-reverberation process includes estimating late reverberation, and subtracting either linearly or non-linearly the estimated late reverberation from the received signal. Referring to FIG. 5C, the output signal from de-reverber 306 is received by bandpass spatial filter 308 of audio agent 122 in which bandpass spatial filter 308 filters noise and side-talk 525. Synthesis filter bank 310 receives the output of bandpass spatial filter 308, and transforms the time-frequency domain signal into a time domain signal 530. Referring to FIG. 5D, end device 120 transmit a processed speech signal 535 to network device 110. In response to receive the speech signal, network 110 converts the speech to text 540. Network 110 transmits text 545 to end device 120. In response to receiving the text, end device 120 performs a function based on the text 550.

Although FIGS. 5A-5D illustrate an exemplary process of the audio processing service, according to other embodiments, the process may include additional operations, fewer operations, and/or different operations than those illustrated in FIGS. 5A-5D, and described herein. For example, the speech signal output from audio agent 122 may be used as a source for further signal processing other than speech-to-text (e.g., voice recognition, a telephone call, etc.).

Figure 6:
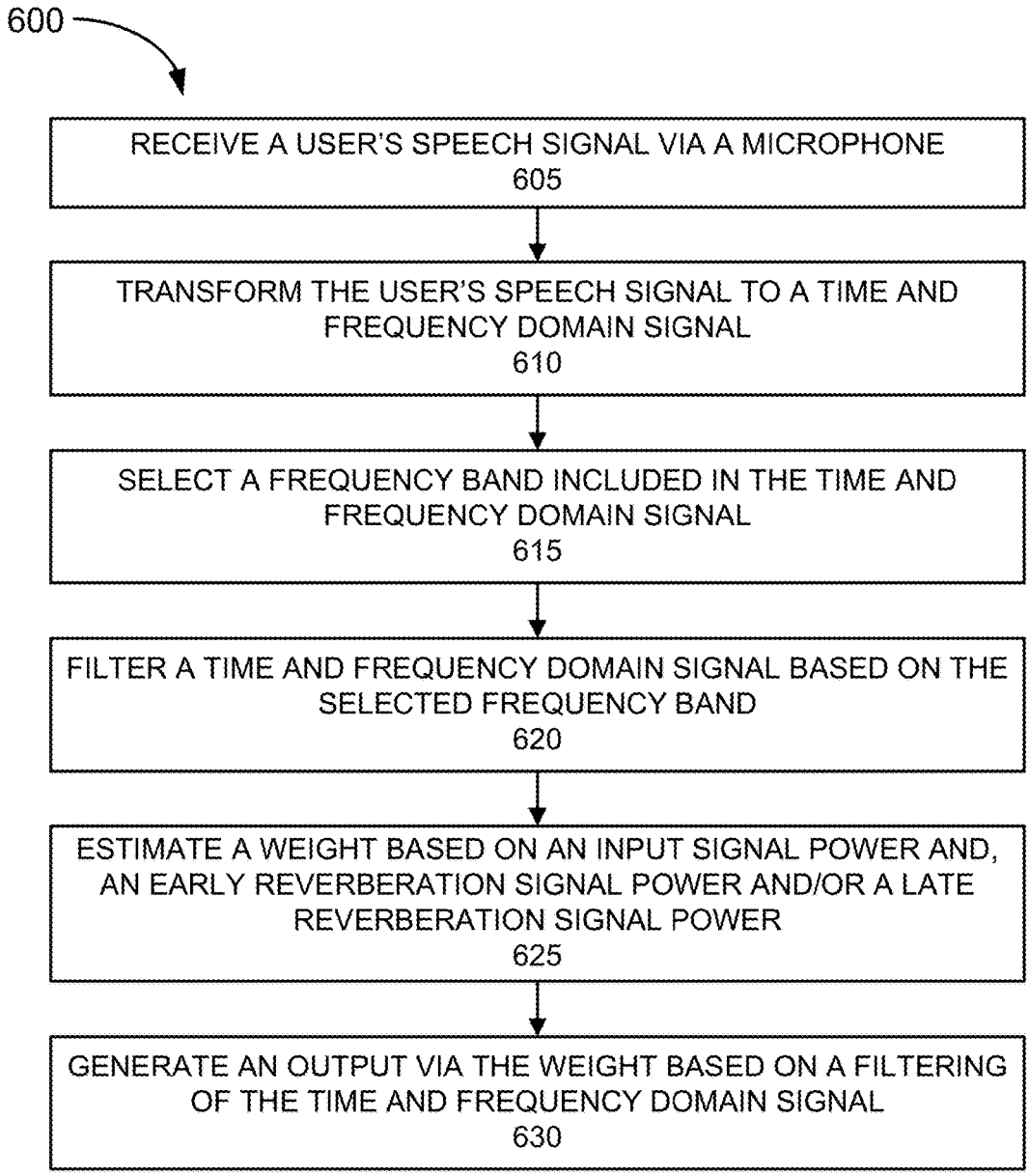
FIG. 6 is a flow diagram illustrating an exemplary process of an exemplary embodiment of the audio processing for speech service.

FIG. 6 is a flow diagram illustrating an exemplary process 600 of an exemplary embodiment of the audio processing service. According to an exemplary embodiment, audio agent 122 performs steps of process 600. For example, processor 410 executes software 420 to perform the steps illustrated in FIG. 6, and described herein.

Referring to FIG. 6, in block 605, a user's speech signal may be received via a microphone. In block 610, the user's speech signal may be transformed to a time and frequency domain signal. In block 615, a frequency band included in the time and frequency domain signal may be selected. Depending on the exemplary implementation, one or multiple frequency bands may be selected. Additionally, for each frequency band selected, blocks 620-630 may be performed. In block 620, a time and frequency domain signal may be filtered based on the selected frequency band. In block 625, a weight may be estimated based on an input signal power and, an early reverberation signal power and/or a late reverberation signal power. For example, the weight may be calculated based on exemplary expression (6) or exemplary expression (9). As previously described, the early reverberation signal power and the late reverberation signal power may be available or estimated. In block 630, an output may be generated via the weight based on a filtering of the time and frequency domain signal. For example, the output may be calculated based on exemplary expression (7).

Although FIG. 6 illustrates an exemplary process 600 of the audio processing service, according to other embodiments, process 600 may include additional operations, fewer operations, and/or different operations than those illustrated in FIG. 6, and described herein.

Figure 7:
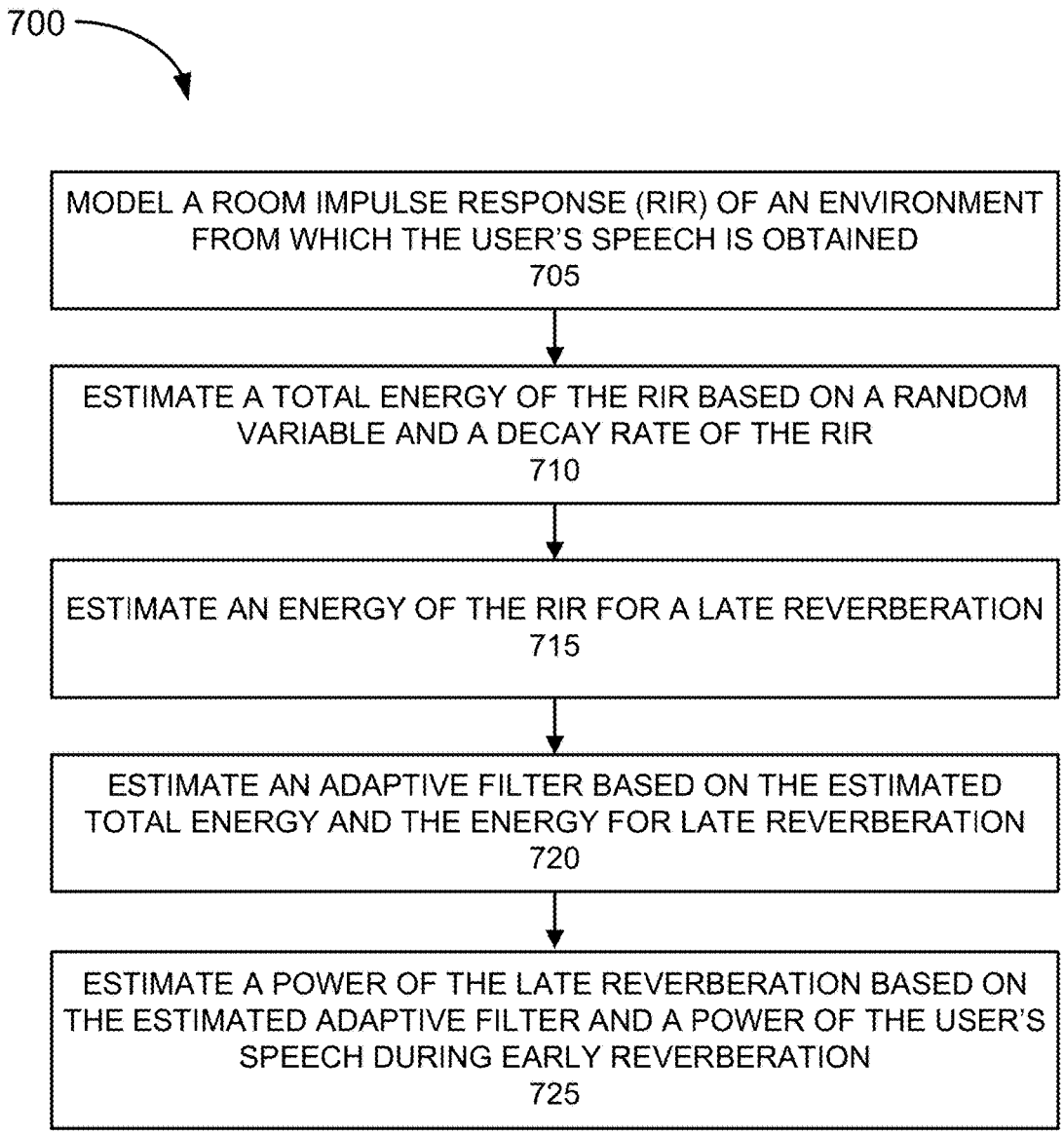
FIG. 7 is a flow diagram illustrating another exemplary process of an exemplary embodiment of the audio processing for speech service.

FIG. 7 is a flow diagram illustrating an exemplary process 700 of an exemplary embodiment of the audio processing service in which the power of late reverberation may be estimated. According to an exemplary embodiment, audio agent 122 performs steps of process 700. For example, processor 410 executes software 420 to perform the steps illustrated in FIG. 7, and described herein.

Referring to FIG. 7, in block 705, a room impulse response of an environment from which a user's speech is obtained is modeled. In block 710, a total energy of the room impulse response is estimated based on a random variable and a decay rate of the room impulse response. In block 715, energy of the room impulse response for a late reverberation is estimated. In block 720, an adaptive filter is estimated based on the estimated total energy and the estimated energy for the late reverberation. In block 725, a power of the late reverberation is estimated based on the estimated adaptive filter and a power of the user's speech during early reverberation.

Although FIG. 7 illustrates an exemplary process 700 of the audio processing service, according to other embodiments, process 700 may include additional operations, fewer operations, and/or different operations than those illustrated in FIG. 7, and described herein.

Figure 8:
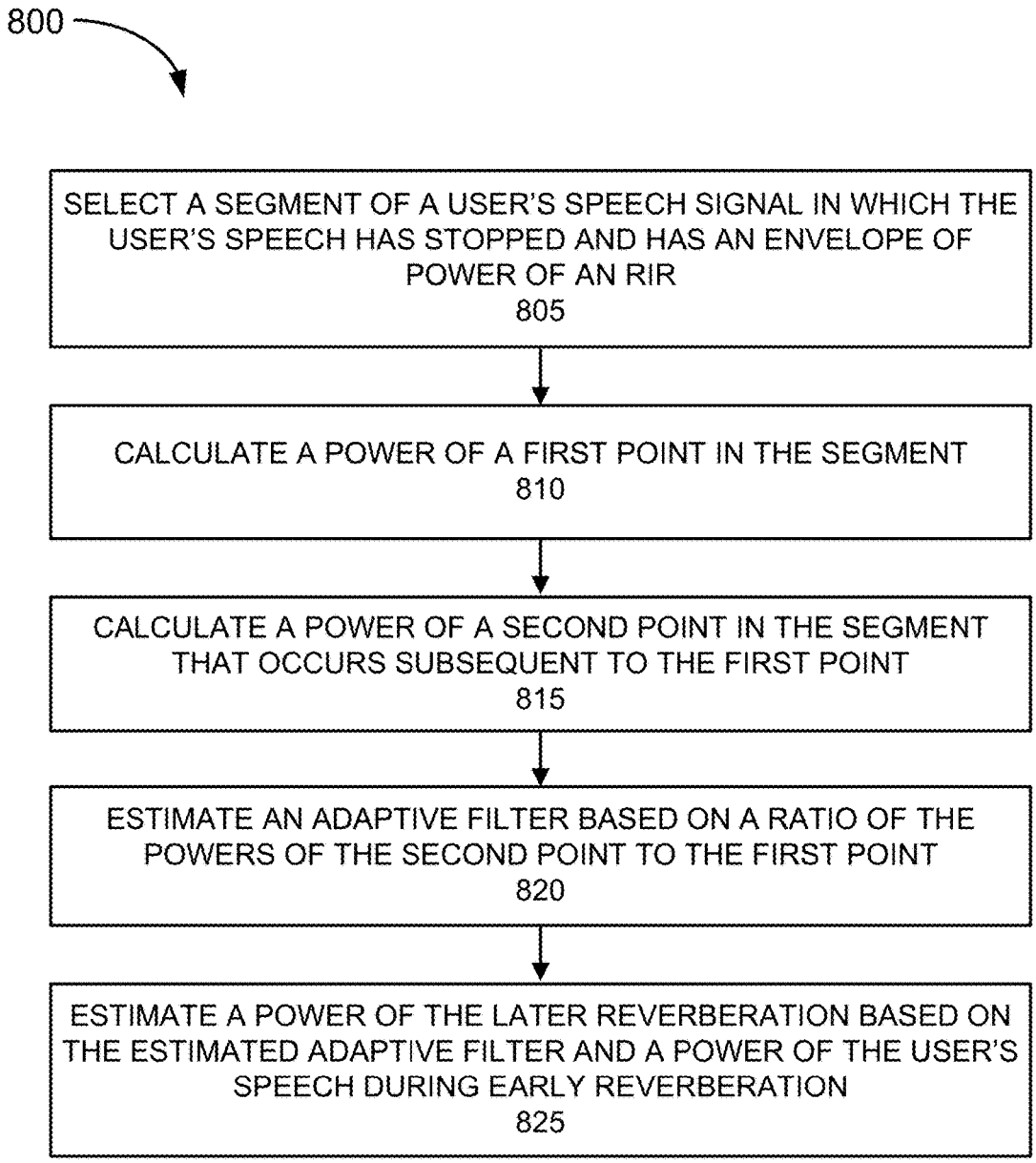
FIG. 8 is a flow diagram illustrating still another exemplary process of an exemplary embodiment of the audio processing for speech service.

FIG. 8 is a flow diagram illustrating another exemplary process 800 of an exemplary embodiment of the audio processing service in which the power of late reverberation may be estimated. According to an exemplary embodiment, audio agent 122 performs steps of process 800. For example, processor 410 executes software 420 to perform the steps illustrated in FIG. 8, and described herein.

Referring to FIG. 8, in block 805, a segment of a user's speech signal, in which the user's speech is stopped and has an envelope of power of a room impulse response, is selected. In block 810, a power of a first point in the segment is calculated. In block 815, a power of a second point in the segment, which occurs subsequent to the first, is calculated. In block 820, an adaptive filter is estimated based on a ratio of the powers of the second point to the first point. In block 825, a power of the late reverberation is estimated based on the estimated adaptive filter and a power of the user's speech during early reverberation.

Although FIG. 8 illustrates an exemplary process 800 of the audio processing service, according to other embodiments, process 800 may include additional operations, fewer operations, and/or different operations than those illustrated in FIG. 8, and described herein.

Figure 9:
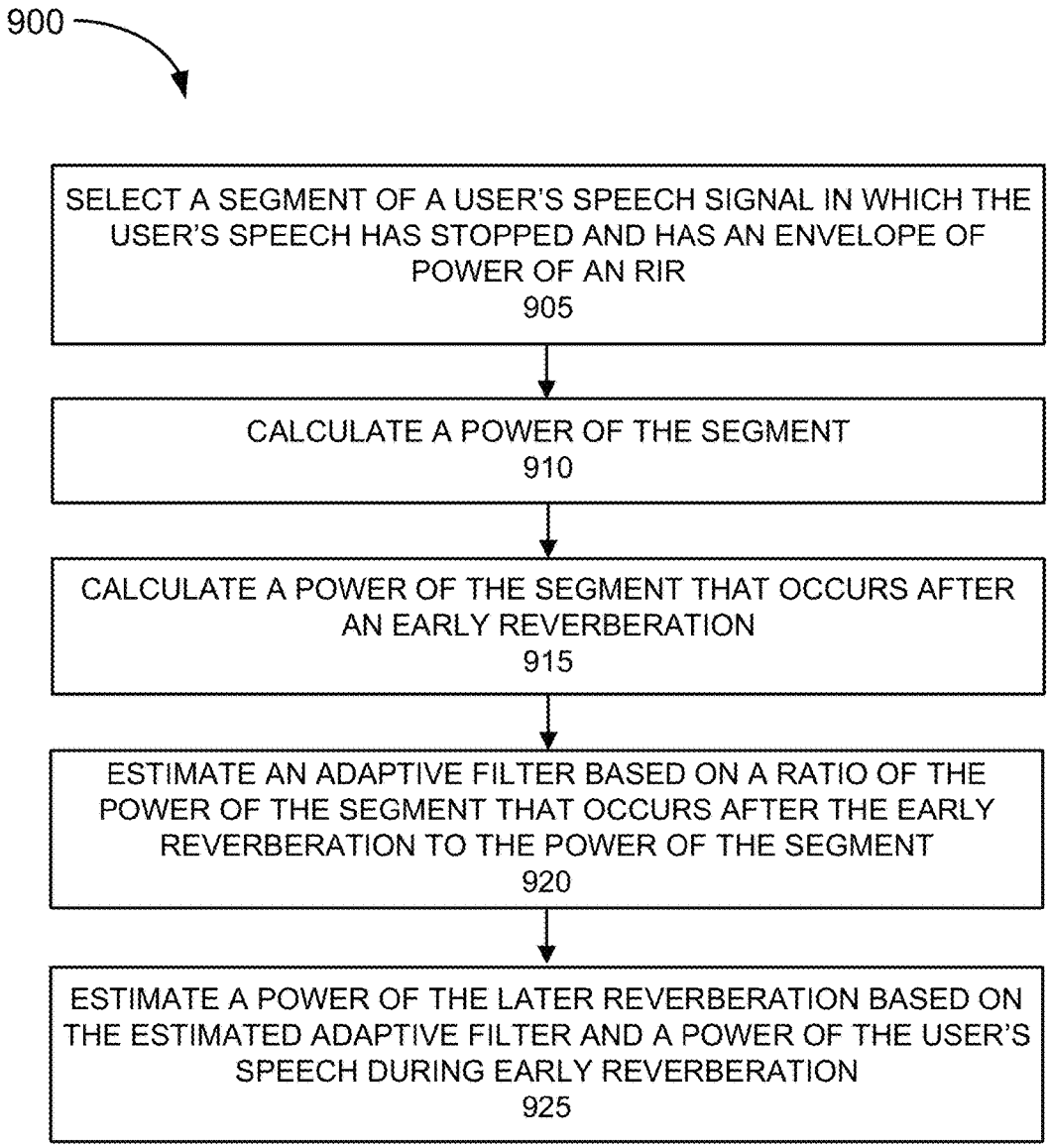
FIG. 9 is a flow diagram illustrating yet another exemplary process of an exemplary embodiment of the audio processing for speech service.

FIG. 9 is a flow diagram illustrating yet another exemplary process 900 of an exemplary embodiment of the audio processing service in which the power of late reverberation may be estimated. According to an exemplary embodiment, audio agent 122 performs steps of process 900. For example, processor 410 executes software 420 to perform the steps illustrated in FIG. 9, and described herein.

Referring to FIG. 9, in block 905, a segment of the user's speech signal is selected corresponding to an envelope of power of the room impulse response. In block 910, a power of the segment is calculated. In block 915, a power of the segment that occurs after an early reverberation is calculated. In 920, an adaptive filter is estimated based on a ratio of the power of the segment that occurs after the early reverberation to the power of the segment. In block 925, a power of the late reverberation is estimated based on the estimated adaptive filter and a power of the user's speech during early reverberation.

Although FIG. 9 illustrates an exemplary process 900 of the audio processing service, according to other embodiments, process 900 may include additional operations, fewer operations, and/or different operations than those illustrated in FIG. 9, and described herein.

Figure 10:
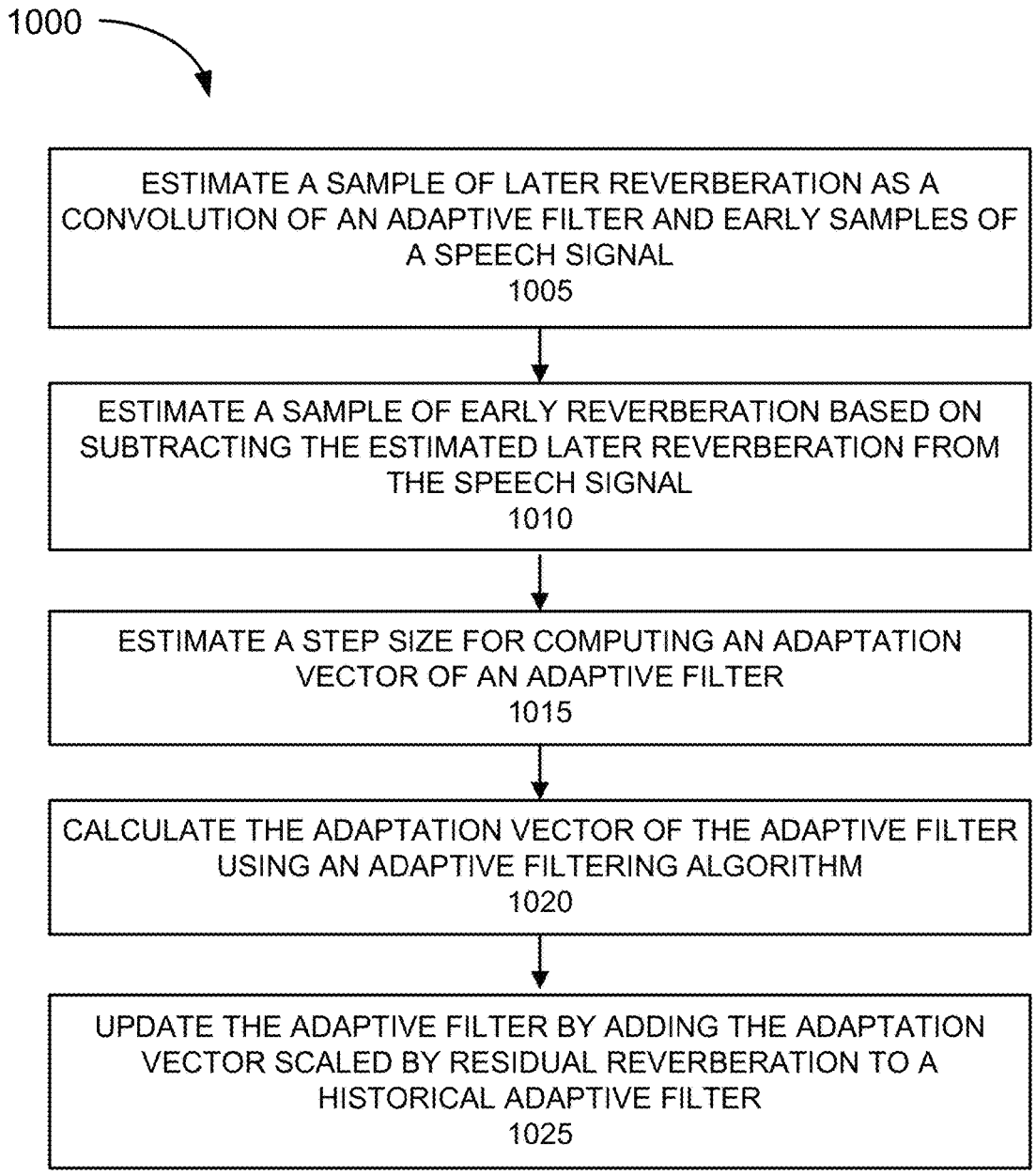
FIG. 10 is a flow diagram illustrating another exemplary process of an exemplary embodiment of the audio processing for speech service.

FIG. 10 is a flow diagram illustrating an exemplary process 1000 of an exemplary embodiment of the audio processing service in which an adaptive filter may be updated. According to an exemplary embodiment, audio agent 122 performs steps of process 1000. For example, processor 410 executes software 420 to perform the steps illustrated in FIG. 10, and described herein.

Referring to FIG. 10, in block 1005, a sample of late reverberation is estimated as a convolution of an adaptive filter and early samples of a user's speech signal. In block 1010, a sample of early reverberation is estimated based on subtracting the estimated late reverberation from the user's speech signal. In block 1015, a step size for computing an adaptation vector of an adaptive filter is estimated. In block 1020, the adaptation vector of the adaptive filter is calculated based on an adaptive filtering algorithm. In block 1025, the adaptive filter is updated based on adding the adaptation vector scaled by residual reverberation to a historical adaptive filter.

Although FIG. 10 illustrates an exemplary process 1000 of the audio processing service, according to other embodiments, process 1000 may include additional operations, fewer operations, and/or different operations than those illustrated in FIG. 10, and described herein.

Figure 11:
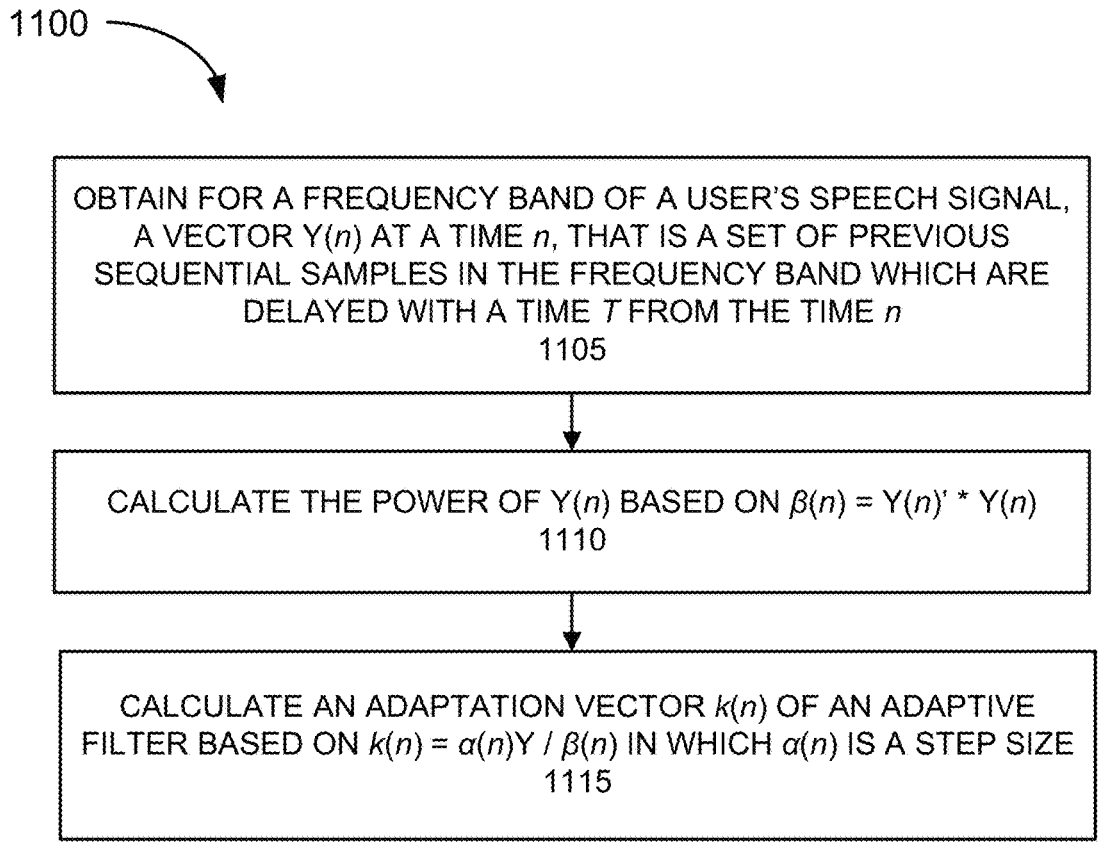
FIG. 11 is a flow diagram illustrating still another exemplary process of an exemplary embodiment of the audio processing for speech service.

FIG. 11 is a flow diagram illustrating an exemplary process 1100 of an exemplary embodiment of the audio processing service in which an adaptation vector for an adaptation filter may be calculated. According to an exemplary embodiment, audio agent 122 performs steps of process 1100. For example, processor 410 executes software 420 to perform the steps illustrated in FIG. 11, and described herein.

Referring to FIG. 11, in block 1105, a vector $Y(n)$ at a time n, that is a set of previous sequential samples in a frequency band of a user's speech signal that are delayed with a time T (early reverberation time) from the time n, is obtained. In block 1110, the power of $Y(n)$ is calculated based on $\beta(n)=Y(n)'*Y(n)$. In block 1115, an adaptation vector $k(n)$ of an adaptive filter is calculated based on $k(n)=\alpha(n)Y(n)/\beta(n)$, in which $\alpha(n)$ is a step size.

Although FIG. 11 illustrates an exemplary process 1100 of the audio processing service, according to other embodiments, process 1100 may include additional operations, fewer operations, and/or different operations than those illustrated in FIG. 11, and described herein.

Figure 12:
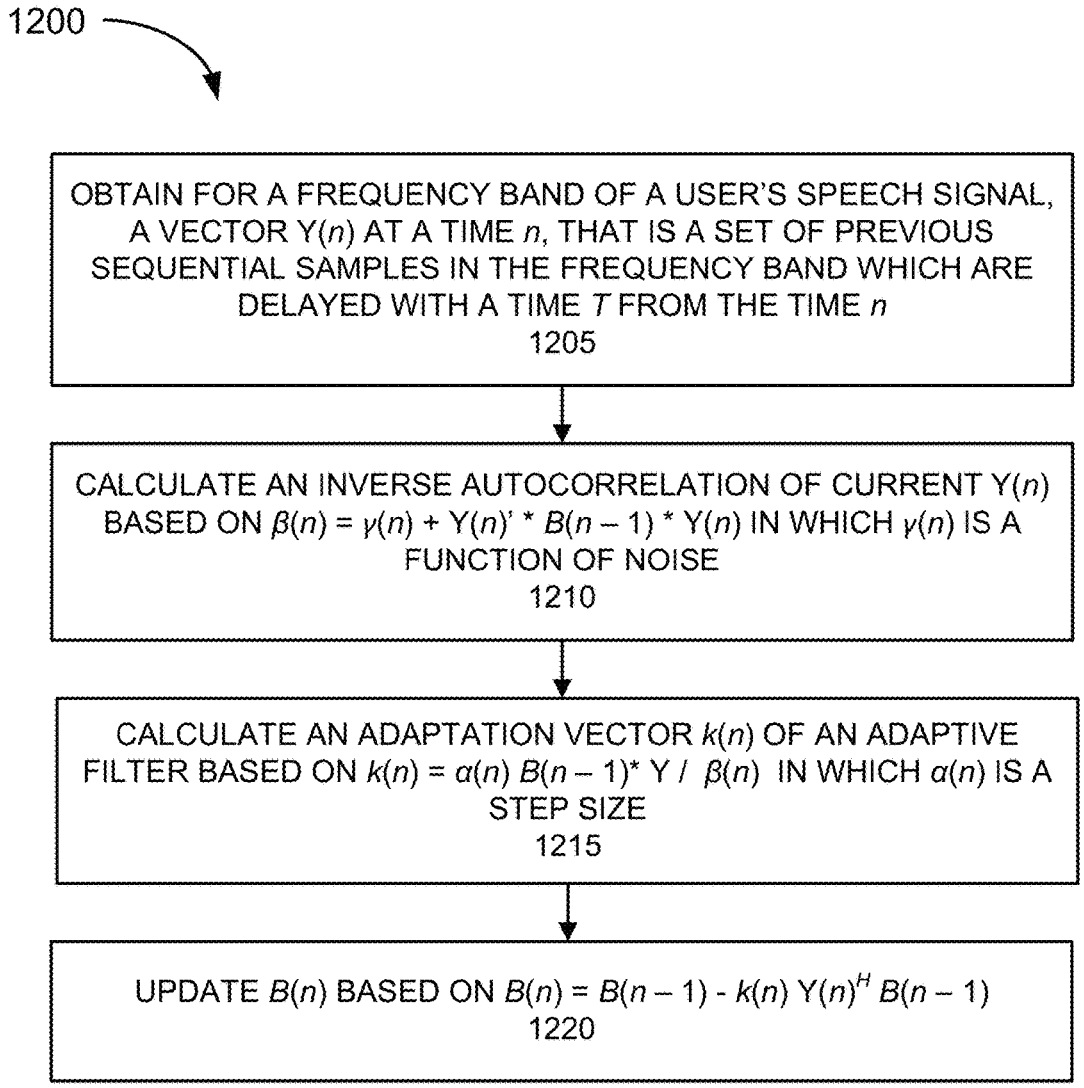
FIG. 12 is a flow diagram illustrating still another exemplary process of an exemplary embodiment of the audio processing for speech service.

FIG. 12 is a flow diagram illustrating another exemplary process 1200 of an exemplary embodiment of the audio processing service in which an adaptation vector for an adaptation filter may be calculated. According to an exemplary embodiment, audio agent 122 performs steps of process 1200. For example, processor 410 executes software 420 to perform the steps illustrated in FIG. 12, and described herein.

Referring to FIG. 12, in block 1205, a vector $Y(n)$ at a time n, that is a set of previous sequential samples in a frequency band of a user's speech signal that are delayed with a time T from the time n, is obtained. In block 1210, an inverse autocorrelation of a current $Y(n)$ is calculated based on $\beta(n)=\gamma(n)+Y(n)'*B(n-1)*Y(n)$, in which $\gamma(n)$ is a function of noise. In block 1215, an adaptation vector k(n) of an adaptive filter is calculated based on $k(n)=\alpha(n)\ B(n-1)*Y(n)/\beta(n)$, in which $\alpha(n)$ is a step size. In block 1220, $\beta(n)$ is updated based on $B(n)=B(n-1)-k(n)Y(n)^{H}B(n-1)$.

Although FIG. 12 illustrates an exemplary process 1200 of the audio processing service, according to other embodiments, process 1200 may include additional operations, fewer operations, and/or different operations than those illustrated in FIG. 12, and described herein.

As set forth in this description and illustrated by the drawings, reference is made to "an exemplary embodiment," "an embodiment," "embodiments," etc., which may include a particular feature, structure or characteristic in connection with an embodiment(s). However, the use of the phrase or term "an embodiment," "embodiments," etc., in various places in the specification does not necessarily refer to all embodiments described, nor does it necessarily refer to the same embodiment, nor are separate or alternative embodiments necessarily mutually exclusive of other embodiment(s). The same applies to the term "implementation," "implementations," etc.

The foregoing description of embodiments provides illustration, but is not intended to be exhaustive or to limit the embodiments to the precise form disclosed. Accordingly, modifications to the embodiments described herein may be possible. For example, various modifications and changes may be made thereto, and additional embodiments may be implemented, without departing from the broader scope of the invention as set forth in the claims that follow. The description and drawings are accordingly to be regarded as illustrative rather than restrictive.

The terms "a," "an," and "the" are intended to be interpreted to include one or more items. Further, the phrase "based on" is intended to be interpreted as "based, at least in part, on," unless explicitly stated otherwise. The term "and/or" is intended to be interpreted to include any and all combinations of one or more of the associated items. The word "exemplary" is used herein to mean "serving as an example." Any embodiment or implementation described as "exemplary" is not necessarily to be construed as preferred or advantageous over other embodiments or implementations.

In addition, while series of blocks have been described with regard to the processes illustrated in FIGS. 6-10, the order of the blocks may be modified according to other embodiments. Further, non-dependent blocks may be performed in parallel. Additionally, other processes described in this description may be modified and/or non-dependent operations may be performed in parallel.

The embodiments described herein may be implemented in many different forms of software executed by hardware. For example, a process or a function may be implemented as "logic," a "component," or an "element." The logic, the component, or the element, may include, for example, hardware (e.g., processor 410, etc.), or a combination of hardware and software (e.g., software 420). The embodiments have been described without reference to the specific software code since the software code can be designed to implement the embodiments based on the description herein and commercially available software design environments and/or languages.

Use of ordinal terms such as "first," "second," "third," etc., in the claims to modify a claim element does not by itself connote any priority, precedence, or order of one claim element over another, the temporal order in which acts of a method are performed, the temporal order in which instructions executed by a device are performed, etc., but are used merely as labels to distinguish one claim element having a certain name from another element having a same name (but for use of the ordinal term) to distinguish the claim elements.

Additionally, embodiments described herein may be implemented as a non-transitory storage medium that stores data and/or information, such as instructions, program code, data structures, program modules, an application, etc. The program code, instructions, application, etc., is readable and executable by a processor (e.g., processor 410) of a computational device. A non-transitory storage medium includes one or more of the storage mediums described in relation to memory/storage 415.

To the extent the aforementioned embodiments collect, store or employ personal information provided by individuals, it should be understood that such information shall be used in accordance with all applicable laws concerning protection of personal information. Additionally, the collection, storage and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

No element, act, or instruction described in the present application should be construed as critical or essential to the embodiments described herein unless explicitly described as such.

What is claimed is:

1. A method comprising:

receiving, by a microphone of a device and from a user, a speech signal, wherein the speech signal includes an early reverberation portion and a late reverberation portion, and wherein the early reverberation portion includes a direct coupling portion in which a path of the user's speech to the device travels a shortest distance to the device and an early reflection portion;

transforming, by a filter of the device, the speech signal to a time and frequency domain signal;

filtering, by the filter of the device, the time and frequency domain signal based on a frequency band included in the time and frequency domain signal;

estimating, by a de-reverber of the device, a power of the late reverberation portion based on a filtered early reverberation portion and a segment of the speech signal in which the user's speech has stopped;

subtracting, by the de-reverber, the estimated power of the late reverberation portion from the speech signal based on the estimating; and outputting, by the de-reverber, a resultant speech signal based on the subtracting.

2. The method of claim 1, wherein the subtracting is performed linearly.

3. The method of claim 1, wherein the subtracting is performed non-linearly.

4. The method of claim 1, wherein the estimating further comprises:

selecting, by the de-reverber of the device, the segment of the speech signal in which the user's speech has stopped;

calculating, by the de-reverber of the device, a first power of a first point in the segment;

calculating, by the de-reverber of the device, a second power of a second point in the segment that occurs subsequent to the first point; and estimating, by the de-reverber of the device, an adaptive filter based on the powers of the first point and the second point.

5. The method of claim 4, further comprising:

estimating, by the de-reverber of the device, the power of the late reverberation portion based on the estimated adaptive filter and a power of the early reverberation portion.

6. The method of claim 1, wherein the segment has an envelope of power of a room impulse response of a room in which the user and the device reside.

7. The method of claim 1, further comprising:

selecting, by the de-reverber of the device, the segment of the speech signal in which the user's speech has stopped; and calculating, by the de-reverber of the device, a first power of the segment.

8. The method of claim 7, further comprising:

calculating, by the de-reverber of the device, a second power of the segment that occurs after early reverberation;

estimating, by the de-reverber of the device, an adaptive filter based on a ratio of the second power to the first power; and estimating, by the de-reverber of the device, the power of the late reverberation portion based on the estimated adaptive filter and a power of the early reverberation portion.

9. A device comprising:

a microphone;

an audio processing system including a filter and a de-reverber;

a memory, wherein the memory stores instructions of the audio processing system; and a processor;

receive, via the microphone and from a user, a speech signal, wherein the speech signal includes an early reverberation portion and a late reverberation portion, and wherein the early reverberation portion includes a direct coupling portion in which a path of the user's speech to the device travels a shortest distance to the device and an early reflection portion; and wherein the processor executes the instructions to:

transform, by the filter, the speech signal to a time and frequency domain signal;

filter, by the filter, the time and frequency domain signal based on a frequency band included in the time and frequency domain signal;

estimate, by the de-reverber, a power of the late reverberation portion based on a filtered early reverberation portion and a segment of the speech signal in which the user's speech has stopped;

subtract, by the de-reverber, the estimated power of the late reverberation portion from the speech signal based on the estimation; and output, by the de-reverber, a resultant speech signal based on the subtraction.

10. The device of claim 9, wherein the subtraction is performed non-linearly or linearly.

11. The device of claim 9, wherein the processor further executes the instructions to:

select, by the de-reverber, the segment of the speech signal in which the user's speech has stopped;

select, by the de-reverber, another segment of the speech signal that occurs subsequent to the segment; and estimate, by the de-reverber, an adaptive filter based on the powers of the segment and the other segment.

12. The device of claim 11, wherein the other segment of the speech signal ends at a silence level or a noise level.

13. The device of claim 11, wherein the processor further executes the instructions to:

estimate, by the de-reverber, the power of the late reverberation portion based on the estimated adaptive filter and a power of the early reverberation portion.

14. The device of claim 9, wherein the processor further executes the instructions to:

select, by the de-reverber of the device, the segment of the speech signal in which the user's speech has stopped;

calculate, by the de-reverber of the device, a first power of a first point in the segment;

calculate, by the de-reverber of the device, a second power of a second point in the segment that occurs subsequent to the first point; and estimate, by the de-reverber of the device, an adaptive filter based on the powers of the first point and the second point.

15. The device of claim 14, wherein the processor further executes the instructions to:

estimate, by the de-reverber, the power of the late reverberation portion based on the estimated adaptive filter and a power of the early reverberation portion.

16. A non-transitory, computer-readable storage medium storing instructions executable by a processor of a computational device, which when executed cause the computational device to:

receive, from a user via a microphone, a speech signal, wherein the speech signal includes an early reverberation portion and a late reverberation portion, and wherein the early reverberation portion includes a direct coupling portion in which a path of the user's speech to the computational device travels a shortest distance to the computational device and an early reflection portion;

transform the speech signal to a time and frequency domain signal;

filter the time and frequency domain signal based on a frequency band included in the time and frequency domain signal;

estimate a power of the late reverberation portion based on a filtered early reverberation portion and a segment of the speech signal in which the user's speech has stopped;

subtract the estimated power of the late reverberation portion from the speech signal based on the estimation; and output a resultant speech signal based on the subtraction.

17. The non-transitory, computer-readable storage medium of claim 16, wherein the instructions further include instructions executable by the processor of the computational device, which when executed cause the computational device to:

select the segment of the speech signal in which the user's speech has stopped;

select another segment of the speech signal that occurs subsequent to the segment;

estimate an adaptive filter based on the powers of the segment and the other segment; and estimate the power of the late reverberation portion based on the estimated adaptive filter and a power of the early reverberation portion.

18. The non-transitory, computer-readable storage medium of claim 17, wherein the other segment of the speech signal ends at a silence level or a noise level.

19. The non-transitory, computer-readable storage medium of claim 16, wherein the instructions further include instructions executable by the processor of the computational device, which when executed cause the computational device to:

select the segment of the speech signal in which the user's speech has stopped;

calculate a first power of a first point in the segment;

calculate a second power of a second point in the segment that occurs subsequent to the first point; and estimate an adaptive filter based on the powers of the first point and the second point.

20. The non-transitory, computer-readable storage medium of claim 19, wherein the instructions further include instructions executable by the processor of the computational device, which when executed cause the computational device to:

estimate the power of the late reverberation portion based on the estimated adaptive filter and a power of the early reverberation portion.

* * * * *